US011050200B2

(12) United States Patent
Sabo

(10) Patent No.: US 11,050,200 B2
(45) Date of Patent: Jun. 29, 2021

(54) ELECTRICAL CONNECTOR WITH HERMAPHRODITIC TERMINAL AND HOUSING

(71) Applicant: FCI USA LLC, Etters, PA (US)

(72) Inventor: James M. Sabo, Marysville, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/456,657

(22) Filed: Jun. 28, 2019

(65) Prior Publication Data

US 2020/0021069 A1 Jan. 16, 2020

Related U.S. Application Data

(60) Provisional application No. 62/696,764, filed on Jul. 11, 2018.

(51) Int. Cl.
*H01R 24/84* (2011.01)
*H01R 13/28* (2006.01)

(52) U.S. Cl.
CPC ..... *H01R 24/84* (2013.01); *H01R 13/28* (2013.01)

(58) Field of Classification Search
CPC ..... H01R 13/434; H01R 13/28; H01R 24/84; H01R 12/00
See application file for complete search history.

(56) References Cited

U.S. PATENT DOCUMENTS 4,552,425 A * 11/1985 Billman ..... H01R 13/28 439/295
4,963,102 A * 10/1990 Gettig ..... H01R 13/28 439/291
6,319,075 B1 11/2001 Clark et al.
6,814,600 B2 * 11/2004 Ruter ..... H01R 13/28 439/290
7,059,919 B2 6/2006 Clark et al.
7,137,848 B1 * 11/2006 Trout ..... H01R 13/514 439/465
7,258,562 B2 8/2007 Daily et al.
7,402,064 B2 7/2008 Daily et al.
7,641,500 B2 * 1/2010 Stoner ..... H01R 13/633 439/357

(Continued)

OTHER PUBLICATIONS

International Search Report and Written Opinion for International Application No. PCT/US2019/039776 dated Oct. 23, 2019.

*Primary Examiner* — Abdullah A Riyami
*Assistant Examiner* — Nader J Alhawamdeh
(74) *Attorney, Agent, or Firm* — Wolf, Greenfield & Sacks, P.C.

(57) ABSTRACT

A power connector assembly with hermaphroditic power connectors. The housing and the terminals of first and second mating power connectors may have like mating interfaces. The first power connector may include a plurality of first terminals, where the mating portion of each first terminal of the plurality of first terminals includes a first flat portion, and a first bent portion coupled to the first flat portion and including a first set of fingers parallel to the first flat portion. The second power connector may include a plurality of second terminals, where each second terminal of the plurality of second terminals includes a mating portion with a second flat portion, and a second bent portion coupled to the second flat portion and including a second set of fingers parallel to the second flat portion.

26 Claims, 20 Drawing Sheets

(56) References Cited

U.S. PATENT DOCUMENTS 7,690,937 B2 4/2010 Daily et al.
7,775,822 B2 8/2010 Ngo et al.
7,862,359 B2 1/2011 Daily et al.
8,062,046 B2 11/2011 Daily et al.
8,323,049 B2 * 12/2012 Ngo ..... H01R 13/6275 439/552
8,403,707 B2 * 3/2013 Tai ..... H01R 13/516 439/397
8,414,323 B2 * 4/2013 Yu ..... H01R 43/16 439/345
10,050,395 B2 * 8/2018 Ngo ..... H01R 13/6275
10,084,257 B2 * 9/2018 Peloza ..... H01R 13/4223
10,249,974 B2 * 4/2019 Copper ..... H01R 13/04
D854,503 S * 7/2019 Gieski ..... D13/147
2003/0232542 A1 * 12/2003 Ruter ..... H01R 13/28 439/638
2003/0236035 A1 * 12/2003 Kuroda ..... H01R 13/432 439/857
2008/0153318 A1 * 6/2008 Weber ..... H01R 12/7082 439/65
2008/0233810 A1 9/2008 Chuang
2010/0203752 A1 * 8/2010 Urano ..... H01R 13/24 439/265
2016/0072200 A1 3/2016 Sabo
2016/0181716 A1 * 6/2016 Ramanna ..... H01R 13/28 439/345
2017/0117645 A1 4/2017 Gieski et al.
2017/0207563 A1 * 7/2017 Dombrowski ..... H01R 4/185
2018/0013224 A1 1/2018 Soudy
2018/0166820 A1 * 6/2018 Peloza ..... H01R 13/28
2018/0301842 A1 * 10/2018 Somanathapura Ramanna ..... H01R 13/28
2018/0331445 A1 * 11/2018 Gieski ..... H01R 12/724
2020/0021069 A1 * 1/2020 Sabo ..... H01R 24/84

* cited by examiner

ELECTRICAL CONNECTOR WITH HERMAPHRODITIC TERMINAL AND HOUSING

CROSS-REFERENCE TO RELATED APPLICATIONS

This application claims the benefit under 35 U.S.C. § 119(e) of U.S. Provisional Application Ser. No. 62/696,764, entitled "Electrical Connector with Hermaphroditic Terminal and Housing" filed on Jul. 11, 2018, the content of which is herein incorporated by reference in its entirety.

BACKGROUND

This application relates generally to electrical interconnection systems, such as those including electrical connectors, used to interconnect electronic assemblies.

Electrical connectors are used in many electronic systems. It is generally easier and more cost effective to manufacture a system as separate electronic sub-assemblies, such as printed circuit boards ("PCBs"), which may be joined together with electrical connectors. A known arrangement for joining several PCBs is to have one PCB serve as a backplane. Other PCBs, called "daughterboards" or "daughtercards", may be connected to the backplane using connectors. Those connectors may be configured to carry signals such that the backplane routes signals between the daughtercards. Other connectors may be configured to carry power.

Conductive elements in power connectors may be configured for carrying power, such as by being wider to support higher currents. Signal conductors, in addition to being narrower, may be positioned relative to other signal conductors or wider conductive elements designated for connection to ground so as to provide a desired impedance in the signal conductors. Combo connectors, integrating in one connector both signal and power conductive elements are also known. Power connectors can be used to couple a supply of power from a subassembly connected to the backplane to the daughtercards also connected to the backplane. In other configurations, power connectors may be coupled to the supply of power via a cable. Those cabled connectors may mate with connectors on a daughtercard, on the backplane or on other components to which power is to be delivered.

Various techniques have been used to route power to the power connectors attached to a backplane. In some systems, the conductive elements in the power connectors may be attached to the backplane such that power is distributed through the backplane. In other systems, power may be routed to connectors via a busbar attached to the backplane or via cables.

SUMMARY

In accordance with one example embodiment, a power connector can include a first terminal. The first terminal can include a first flat portion and a first bent portion. The first bent portion can include a first end and a second end, the first end being coupled to the first flat portion and the second end comprising a first set of fingers comprising contact surfaces facing the first flat portion.

According to one aspect, the first flat portion has a first end and a second end with the first end of the first bent portion being coupled to the first flat portion at the first end of the first flat portion and the second end of the first flat portion extends beyond the second end of the first bent portion in a direction from the first end to the second end of the first flat portion.

According to another aspect, the first flat portion comprises a surface facing the first bent portion and the surface comprises at least one raised portion forming a contact surface.

According to another aspect, the first terminal further comprises a second flat portion, and a second bent portion comprising a first end and a second end, the first end being coupled to the second flat portion and the second end comprising a second set of fingers parallel to the second flat portion.

According to another aspect, the first flat portion, the second flat portion, the first bent portion and the second bent portion are integral metal members.

According to another aspect, the first flat portion, the second flat portion, the first bent portion and the second bent portion together have a cross section that is less than 10 mm square.

According to another aspect, the first terminal further comprises a band connecting the first flat portion to the second flat portion.

According to another aspect, a contact tail extends from the band or a bottom surface of the first flat portion or second flat portion.

According to another aspect, the contact tail is a cable mount contact tail, a right angle surface mount contact tail, a vertical surface mount contact tail, or a press fit contact tail.

According to another aspect, the first set of fingers comprises at least three fingers, each of the at least three fingers providing a contact surface facing the first flat portion and the second set of fingers comprises at least three fingers, each of the at least three fingers providing a contact surface facing the second flat portion.

According to another aspect, the power connector is in combination with a second power connector, the second power connector comprising: a second terminal comprising: a second flat portion, and a second bent portion comprising a first end and a second end, the first end being coupled to the second flat portion and the second end comprising a second set of fingers parallel to the second flat portion.

According to another aspect, the first terminal and the second terminal are mated to each other, with the second set of fingers of the second terminal contacting a surface of the first flat portion and the first set of fingers of the first terminal contacting a surface of the second flat portion.

According to another aspect, the second set of fingers provide at least three points of contact with the surface of the first flat portion and the first set of fingers provide at least three points contact with the surface of the second flat portion.

According to another aspect, at least two points of contacts are provided on the first flat portion and/or the second flat portion thereby providing sixteen points of contact when the first terminal and the second terminal are mated to each other.

According to another aspect, at least one of the first flat portion and second flat portion comprises a raised portion providing a contact surface pressing against a surface of the other of the first flat portion and second flat portion.

In another example embodiment, a power connector assembly can include a first power connector and a second power connector configured to mate with the first power connector. The first power connector can include a plurality of first terminals and the second power connector can include a plurality of second terminals. Each first terminal of the plurality of first terminals can include a first flat portion and a first bent portion. The first bent portion can include a first end and a second end, the first end being coupled to the first flat portion and the second end comprising a first set of fingers parallel to the first flat portion. Each second terminal of the plurality of second terminals can include a second flat portion and a second bent portion. The second bent portion can include a first end and a second end, the first end being coupled to the second flat portion and the second end comprising a second set of fingers parallel to the second flat portion.

According to one aspect, each first terminal of the first power connector is mated to a corresponding second terminal of the second power connector, with the second set of fingers of the second terminal contacting a surface of the first flat portion of the first terminal and the first set of fingers of the first terminal contacting a surface of the second flat portion of the second terminal.

According to another aspect, the second set of fingers provides at least three points of contact with the surface of the first flat portion and the first set of fingers provides at least three points of contact with the surface of the second flat portion.

According to another aspect, one of the first flat portion and second flat portion comprises a raised portion providing a contact surface pressing against a surface of the other of the first flat portion and second flat portion.

According to another aspect, each first terminal of the first power connector is mated to a corresponding second terminal of the second power connector and sixteen points of contact are provided between the mating terminals.

According to another aspect, the power connector assembly has a current capacity between 75 and 125 Amps.

According to another aspect, the first and second power connectors are cable mount power connectors.

According to another aspect, the first power connector is a cable mount power connector and the second power connector is a right angle surface mount power connector.

According to another aspect, the first power connector is a cable mount power connector and the second power connector is a vertical surface mount power connector.

According to another aspect, the first power connector is a vertical surface mount power connector and the second power connector is a right angle surface mount power connector.

In yet another example embodiment, a method of manufacturing a terminal for a power connector is provided. The method can include stamping from a sheet of metal a blank comprising a first elongated portion and a second elongated portion comprising a plurality of fingers, bending the second elongated portion to be parallel with the first elongated portion, and forming the second elongated portion such that each of the fingers comprises a convex portion facing the first elongated portion.

According to one aspect, the method further comprises forming a raised portion on the first elongated portion.

According to another aspect, the blank comprises a third elongated portion and a fourth elongated portion; and the method further comprises: forming in the fourth elongated portion a plurality of fingers, and bending the fourth elongated portion such that the plurality of fingers are parallel with the third elongated portion, and each of the plurality of fingers comprises a convex portion facing the third elongated portion.

The foregoing aspects may be used alone, or any number may be used together, in any of the embodiments described herein.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

Figure 1A:
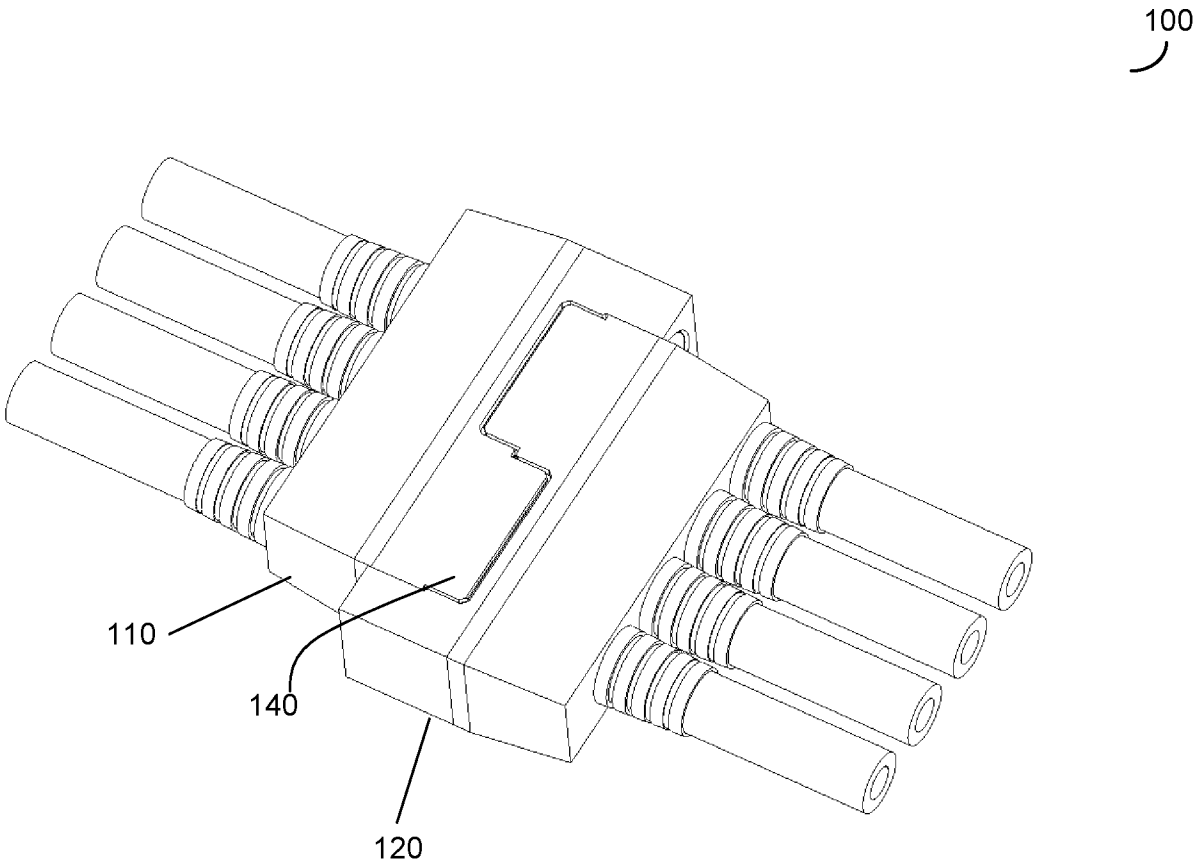
FIG. 1A is a perspective view of two exemplary hermaphroditic power connectors when mated, according to one embodiment.

10A-10B are side views of exemplary power terminals with one or more helper springs, shown in phantom, during assembly.

DETAILED DESCRIPTION

Aspects of the present disclosure relate to improved interconnection systems with a low-cost power connector assembly.

The inventors have recognized and appreciated techniques for designing power connectors that are capable of carrying large amounts of current in a small volume, at low manufacturing cost.

The inventors have recognized and appreciated that hermaphroditic power connectors, where the housing and/or the terminals on both sides of the connector assembly have a like shape, can be manufactured with the same tooling and machinery such that fewer stamping or folding dies are required to make both mating connectors. Accordingly, manufacturing costs of the connector assembly are low.

The inventors have further recognized and appreciated designs for such terminals that can carry large amounts of current and further that such current carrying capacity can be provided in a small volume. A large current capacity may be achieved with a larger number of contact points between connectors. A density of contact points may be provided with terminals having a blade and multiple fingers facing the blade. Upon mating to a like terminal, the blade of one terminal may fit between the fingers and blade of the other terminal. A contact surface on each finger may provide a low resistance contact to the blade of the mating terminal. The fingers may also exert spring force pressing the blades together. One or more contact surfaces on one or both of the blades may provide further low resistance points of contact between the terminals.

In some embodiments, a terminal may have two or more mating regions, each with a blade and opposing fingers. In an exemplary embodiment, a terminal with two such mating regions may provide 16 points of contact: 3 points of contact associated with 3 fingers contacting a blade in each mating region, providing 6 points of contact on the fingers on the 2 mating terminals. Two additional points of contact may be provided on the blades. With two mating regions, each with 8 points of contact, a total of 16 points of contact are provided between the mating terminals.

In accordance with some embodiments, each terminal, with multiple points of contact may be stamped and formed from the same sheet of metal. The fingers and blades may initially be stamped as elongated members in the same plane. The fingers may then be folded to be parallel to the blades. Where two mating regions are provided per terminal, similar structures may be stamped from the same sheet of metal, with a band connecting the mating regions. Structures that are formed into contact tails for the terminal may be integrally formed with the band.

Referring to FIGS. 1A-1D, an example power connector assembly 100 can include hermaphroditic power connectors. In the embodiment illustrated in FIG. 1A, the power connectors are configured as cable connectors of which a first cable mount power connector 110 is mated to a second cable mount power connector 120. Power connectors 110 and 120 may have like structures, with the housing and the terminals of each connector having like shapes.

Figure 1B:
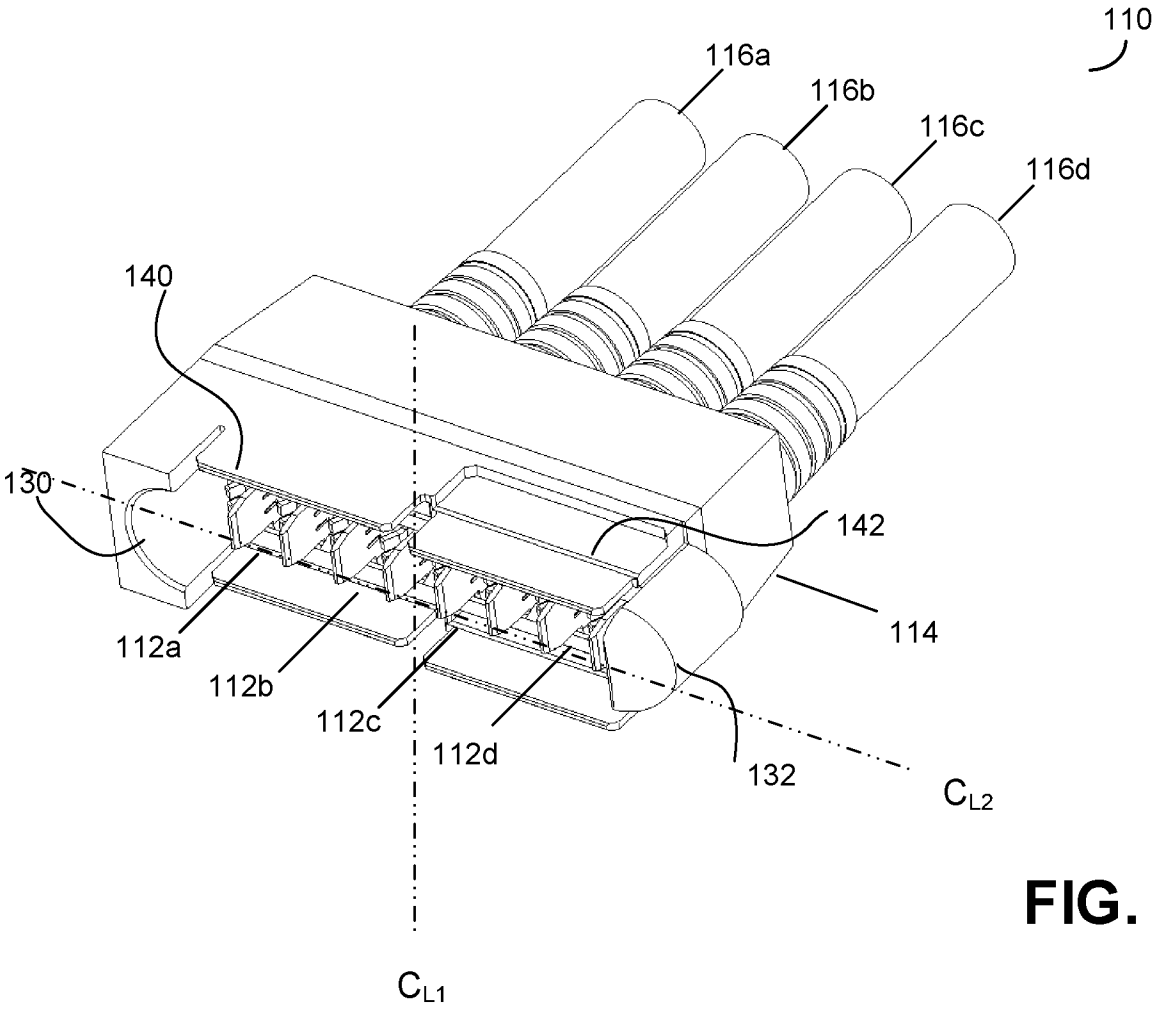
FIG. 1B is a front, right side perspective view of exemplary connector 110 of FIG. 1A when unmated.
Figure 1C:
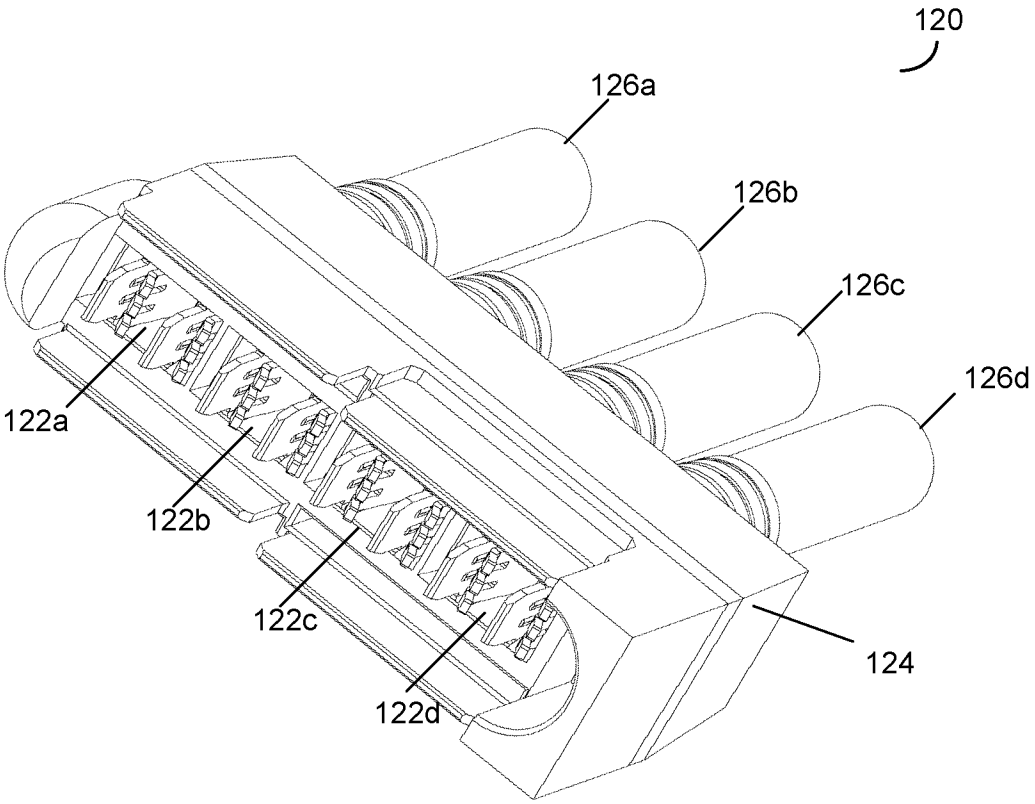
FIG. 1C is a front, right side perspective view of exemplary connector 120 of FIG. 1A when unmated.

As shown in FIGS. 1B and 1C, each of the first and second cable mount power connectors 110, 120 can include multiple terminals supported by a housing. For example, the first cable mount power connector 110 can include first terminals 112*a*, 112*b*, 112*c*, and 112*d* that are supported by housing 114. Similarly, the second cable mount power connector 120 can include second terminals 122*a*, 122*b*, 122*c*, and 122*d* that are supported by housing 124. Each first terminal of the first cable mount power connector 110 is configured to mate with a corresponding second terminal of the second cable mount power connector 120. In the embodiment illustrated, each of the terminals has two mating regions. Each mating region, is illustrated as comprising a blade and a plurality of contact fingers. It should be appreciated that power terminals may be made with more or fewer mating regions, such as one mating region. Moreover, a connector may have more or fewer than four terminals.

The housings 114 and 124 may each have complimentary features to facilitate mating of like housings. Referring to FIG. 1B, housing 114 has complimentary alignment features. In the illustrated embodiment, the complimentary alignment features include an opening 130 and protrusion 132, sized to fit within opening 130. Protrusion 132 and/or the mouth of opening 130 may be tapered to facilitate alignment. When a mating connector with a like housing, rotated 180 degrees, such as connector 120 (FIG. 1C) is mated with connector 110, an opening 130 on connector 110 will receive a protrusion 132 from the mating connector. Likewise, protrusion 132 of connector 110 will fit within the opening 130 of the mating connector.

Housings 114 and 124 may also include features that enclose the terminals while still allowing mating of like housings. In the embodiment illustrated in FIG. 1B, a top surface has first and second tabs 140 and 142. Each of the tabs 140 and 142 is positioned above the mating regions of a portion of the plurality of terminals in the connector. Similar tabs (not numbered) are positioned below the terminals such that the terminals are positioned behind tabs that can block unwanted contact to the terminals from the top and bottom. Other portions of the housing block unwanted contact to the terminals from the sides and back, leaving the contacts exposed at a mating interface.

Tabs 140 and 142 may be sized and positioned to enable mating of like connectors. In the embodiment illustrated, tabs 140 and 142 are symmetrically positioned around a lateral centerline $C_{L1}$. However, tabs 140 and 142 are positioned at different distances from a transverse centerline $C_{L2}$. The difference in distances equals or slightly exceeds the thickness of tab 140, which is further from the transverse centerline $C_{L2}$. When connector 110 is mated to a connector with a like housing, tab 140 will align, in the lateral direction, with tab 142 of the like housing. However, tab 140 will be above tab 142 of the like housing, such that connector 110 may be mated with the connector with the like housing, as shown in FIG. 1A. A similar arrangement of tabs interlock at the bottom of the mating connectors.

Referring to FIGS. 1B and 1C, each of the first terminals 112*a*-112*d* may be attached, respectively, to an electrical cable 116*a*-116*d* so as to place the electrical cable in electrical communication with the terminal. Each of the second terminals 122*a*-122*d* may be attached, respectively, to an electrical cable 126*a*-126*d* so as to place the electrical cable in electrical communication with the terminal. In some embodiments, the first/second terminals may be attached to the respective electrical cables by welding or crimping.

Figure 1D:
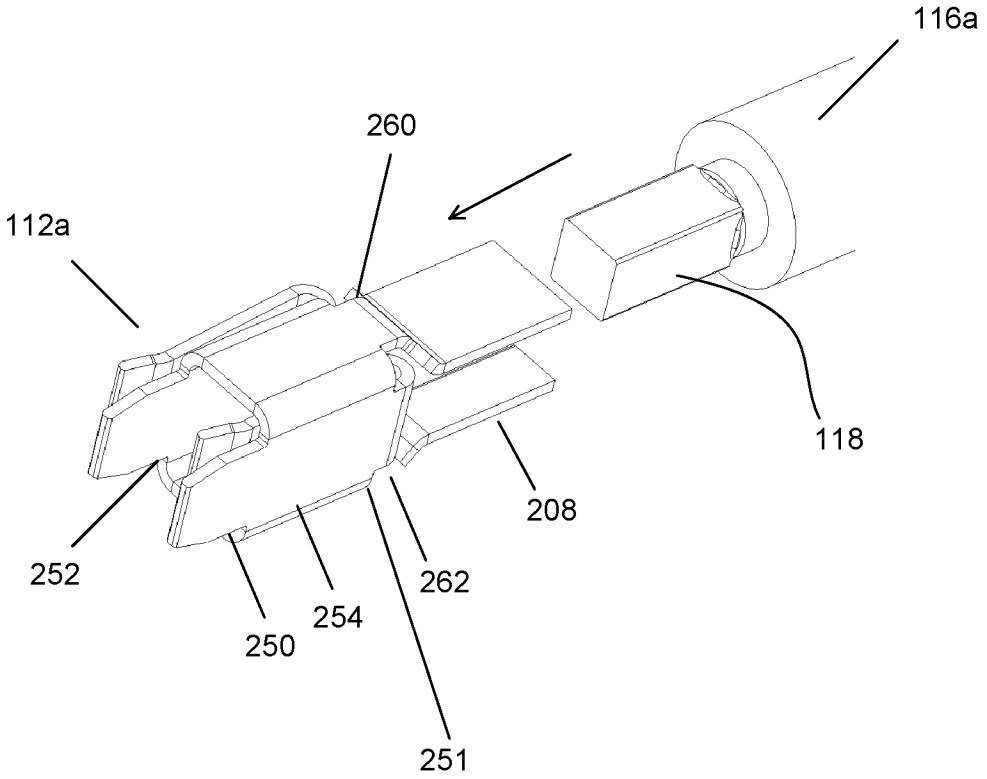
FIG. 1D is a perspective view of a step of terminating a cable with a terminal in accordance with some embodiments.

FIG. 1D illustrates a terminal 112*a*, which may be illustrative of terminals 112*a* . . . 112*d* or 122*a* . . . 122*d*, being attached to an electrical cable 116*a*, which may be illustrative of cables 116*a* . . . 116*d* or 126*a* . . . 126*d*, for example, by welding, brazing, soldering. In the embodiment illustrated, the conductors within cable 116*a* may be fused into a lug 118, such as by welding. A welded interface between lug 118 and terminal 112*a* may provide a low resistance contact to the terminal, though any suitable attachment mechanism may be used. In some embodiments, cables, such as cable 116*a* illustrated in FIG. 1D may be a large gauge wire, such as a wire having an AWG of less than 8 AWG, such as 4 AWG. Such a wire, when terminated with a terminal as illustrated in FIG. 1D may provide a cable assembly with a current carrying capacity in excess of 75 Amps, and may be between for example, 75 and 125 Amps. The current carrying capacity may be determined in any suitable way, including using known rating systems that measure current that produces a temperature rise that is less than a specified maximum value. As a specific example, the current carrying capacity may be determined by the current that yields a temperature rise of less than 30-degree Centigrade.

The configurations described herein enable terminals to provide such large current carrying capacities in a relatively small volume. A terminal as described herein with two blades and two sets of fingers may fit in a small volume. The mating portion, for example, may have a square cross section that is 20 mm per side, or in some embodiments, less than 15 mm per side, or less than 10 mm per side, or equivalent non-square area. In some embodiments, the cross section may be between 5 and 15 mm per side or between 5 and 10 mm per side, and still provide current carrying capacity in excess of 75 Amps, as described above. However, it should be appreciated that other current capacities are possible or that smaller sizes are possible.

Figure 2:
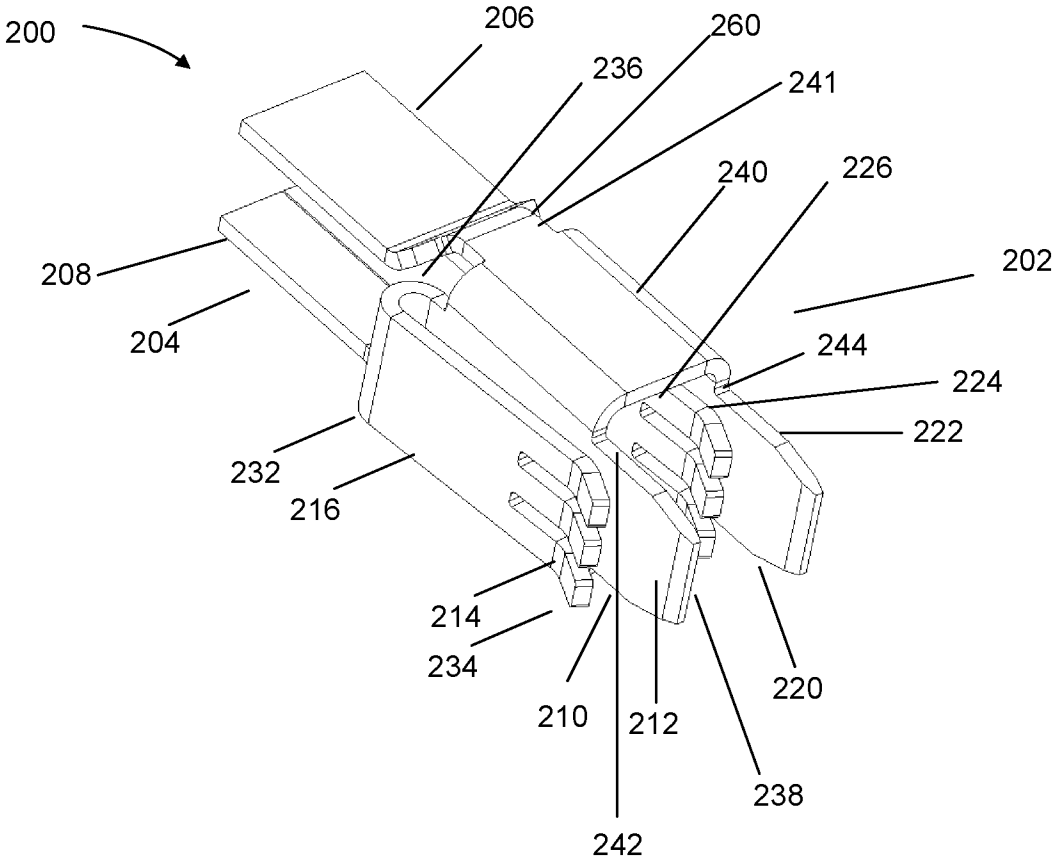
FIG. 2 illustrates an example terminal of a power connector, according to one embodiment.

Each of the first terminals 112*a*-112*d* and second terminals 122*a*-122*d* have a like shape, as depicted by terminal 200 in FIG. 2, for example. In the example of FIG. 2, terminal 200 has a mating portion 202 with two mating regions 210, 220 and a mounting portion 204 having tails 206 and 208. In the embodiment illustrated, tails 206 and 208 are configured to electrically connect to an electrical cable. Accordingly, terminal 200 is configured for use in a cable connector as illustrated in FIGS. 1A . . . 1D. However, terminal 200 may mate with terminals with tails configured for use in other connector configurations that have mating portions of the same configuration as mating portion 202.

Mating region 210 may include a first blade 212 and a first set of fingers 214. Here, blade 212 is a substantially flat, though a forward edge may be tapered, coined or otherwise shaped to, upon mating with a like terminal, pass between similar fingers and a similar blade of the mating terminal.

Fingers 214 have mating contact surfaces facing blade 212. The distal tips of fingers 214 may be curled away from blade 212. Such a configuration may facilitate mating with a like terminal, as it will facilitate insertion of a blade of a like terminal between blade 212 and fingers 214.

In the embodiment illustrated, there are three fingers 214 and one blade 212. however, it should be appreciated that a terminal may be formed with more than one blade and/or more or less than three fingers.

Upon mating with a like terminal, a corresponding blade from the mating connector may pass between fingers 214 and blade 212. Fingers 214 may press against the blade from the mating terminal, both establishing points of contact between fingers 214 and the blade of the mating terminal and pressing the blade of the mating terminal against blade 212.

In some embodiments, blade 212 and fingers 214 may be formed from a unitary sheet of metal. In such a configuration, fingers 214 may be cut in a first bent portion 216, which is integral with blade 212, but is bent so as to position fingers 214 facing blade 212. The first bent portion 216 may include a first end 232 and a second end 234, the first end 232 being coupled to blade 212 and the second end 234 including the fingers 214 parallel to blade 212. Blade 212 may include a first end 236 and a second end 238 with the first end 232 of the first bent portion 216 being coupled to the blade 212 at the first end 236 of blade 212. The second end 238 of blade 212 may extend beyond the second end 234 of the first bent portion 216 in a direction from the first end 236 to the second end 238 of blade 212. In some embodiments, the first set of fingers 214 may include at least three fingers, each of the at least three fingers providing a contact surface facing blade 212. However, it should be appreciated that set of fingers 214 may include more or less than three fingers.

Similarly, mating region 220 may include a second blade 222 parallel to the first blade 212 and a second set of fingers 224 on a second bent portion 226, the second set of fingers 224 being parallel to the second blade 222. The configuration of the second blade 222, the second bent portion 226, and the second set of fingers 224 may be similar to the configuration of the first blade 212, first bent portion 216, and the first set of fingers 214 described above. In some embodiments, the second set of fingers 224 may include at least three fingers, each of the at least three fingers providing a contact surface facing the second flat portion 222. However, it should be appreciated that the second set of fingers 224 may include more or less than three fingers.

In some embodiments, mating regions 210 and 220 may be formed from an integral sheet of metal. In such an embodiment, terminal 200 may include a first band 240 connecting a first surface 242 of blade 212 and a first surface 244 of the second blade 222. Terminal 200 may further include a second band 250 (as shown in FIG. 1D) connecting a second surface 252 of blade 212 and a second surface 254 of blade 222.

In some embodiments, tails 206, 208 of the mounting portion 204 extend from the first and second bands 240, 250, respectively. Each of the tails 206, 208 of the mounting portion 204 may represent a cable mount contact tail. Referring to FIGS. 1D and 2, terminal 200 may include a first transition region 260 that extends from a front end of tail 206 of mounting portion 204 to a rear end 241 of the first band 240 and a second transition region 262 that extends from a front end of tail 208 of mounting portion 204 to a rear end 251 of the second band 250. The first transition region 260 may be curved downwards along at least a portion of its length between the rear end 241 of the first band 240 and the front end of tail 206. The second transition region 262 may be curved upwards along at least a portion of its length between the rear end 251 of the second band 250 and the front end of tail 208. The first and second transition regions 260, 262 may be configured to transmit electrical current between the mounting portion 204 and the mating portion 202, for example, from the mounting portion 204 to the mating portion 202.

Figure 3B:
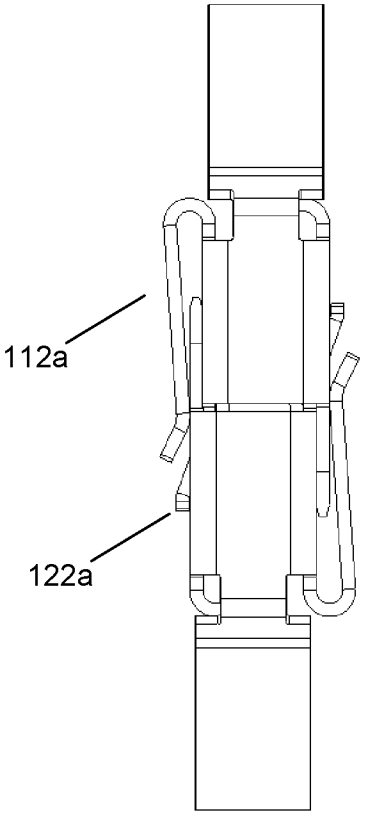
FIGS. 3A and 3B are top plan views of two exemplary terminals of power connectors shown unmated in FIG. 3A and mated in FIG. 3B, according to some embodiments.
Figure 3A:
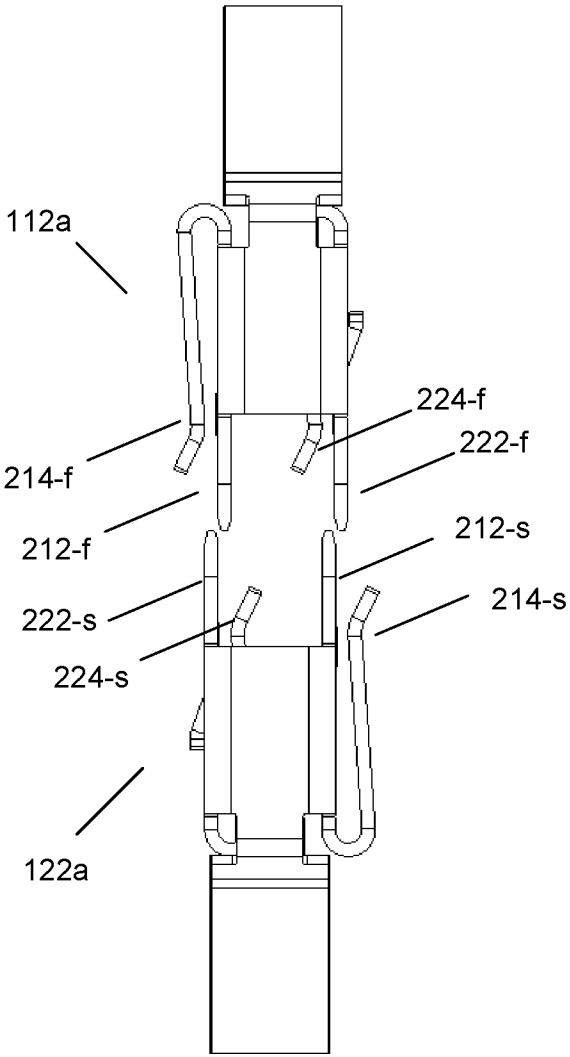
Figure 3D:
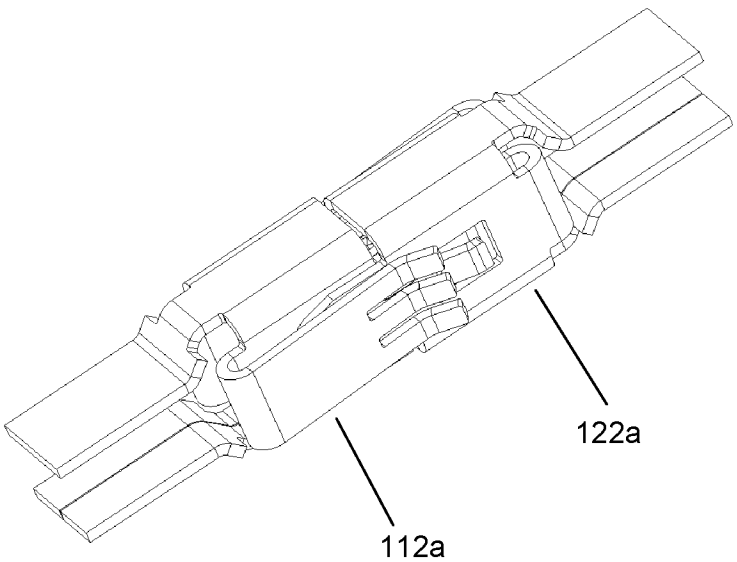
FIGS. 3C and 3D are perspective views of the exemplary terminals of power connectors of FIG. 3A and FIG. 3B.

FIGS. 3A and 3B depict top plan views of a first terminal, such as terminal 112*a*, of the first cable mount power connector 110 and a second terminal, such as terminal 122*a*, of the second cable mount power connector 120. The first terminal 112*a* of the first cable mount power connector 110 is configured to mate with a corresponding second terminal 122*a* of the second cable mount power connector 120. In the embodiment illustrated, each of the first terminal 112*a* and second terminal 122*a* may be configured like terminal 200 (FIG. 2).

FIGS. 3A and 3B illustrate the configuration of the first and second terminals prior to and after being mated to each other. In FIGS. 3A and 3B, first and second blades of terminal 112*a* are labeled as 212-*f* and 222-*f*, respectively; the first and second sets of fingers of terminal 112*a* are labeled as 214-*f* and 224-*f*, respectively; the first and second blades of terminal 122*a* are labeled as 212-*s* and 222-*s*, respectively; and the first and second set of fingers of terminal 122*a* are labeled as 214-*s* and 224-*s*.

Upon mating, 1) the first blade 212-*f* of the first terminal 112*a* fits between the second blade 222-*s* and the second set of fingers 224-*s* of the second terminal 122*a*, with the second set of fingers 224-*s* of the second terminal 122*a* contacting a surface of first blade 212-*f* of the first terminal 112*a* and the first set of fingers 214-*f* of the first terminal 112*a* contacting a surface of the second blade 222-*s* of the second terminal 122*a*, and 2) the second blade 222-*f* of the first terminal 112*a* fits between the first blade 212-*s* and the first set of fingers 214-*s* of the second terminal 122*a*, with the first set of fingers 214-*s* of the second terminal 122*a* contacting a surface of the second blade 222-*f* of the first terminal 112*a* and the second set of fingers 224-*f* of the first terminal 112*a* contacting a surface of the first blade 212-*s* of the second terminal 122*a*.

The fingers and the blades of each of the first and second terminals may have multiple points of contact, forming, in the aggregate a low resistance, separable connection between the first and second terminals. Points of contact may be formed between the fingers of one terminal and a blade of a mating terminal. Additionally, points of contact may be formed between blades of the mating terminals, providing additional points of contact that provides an even lower resistance, separable connection.

Contact surfaces on fingers 214-*s* and 224-*f* may be formed on concave segments bent into the fingers and/or by selectively coating a suitable contact coating on those portions. Similarly, contact surfaces on fingers 214-*f* and 224-*s* may be formed on concave segments bent into the fingers and/or by selectively coating a suitable contact coating on those portions. Examples of suitable contact coatings include soft metals such as gold or silver and/or metals that are resistant to tarnishing such as nickel or tin, or alloys of any of the above. Portions of the surfaces of the blades against which the fingers press may similarly have a suitable contact coating applied thereto.

Contact surfaces on blades 212-*s* and/or 222-*f* for facilitating contact between blades may be formed in any suitable way. In some embodiments, contact surfaces may be formed using techniques such as by embossing dimples, bumps or other raised portion in one or both of the blades, and/or by coating a suitable contact metal on selective portions of the blade. In some embodiments, contact surfaces may be formed on opposing sides of each of blades 212-*s* and 222-*f*. On a surface facing respective fingers, contact surfaces may be formed as projections. On an opposite surface, contact surfaces may be formed by applying a coating. Such a contact surface may provide a low resistance contact with fingers of a mating terminal. Projections, on the other hand, may provide a low resistance contact to a blade of a mating terminal. Similar contact surfaces may be formed on blades 212-*f* and/or 222-*s*.

Accordingly, a contact surface on each finger of the first set of fingers 214-*f* of the first terminal 112*a* may provide a low resistance contact to the second blade 222-*s* of the second terminal 122*a*. A contact surface on each finger of the second set of fingers 224-*f* of the first terminal 112*a* may provide a low resistance contact to the first blade 212-*s* of the second terminal 122*a*. A contact surface on each finger of the first set of fingers 214-*s* of the second terminal 122*a* may provide a low resistance contact to the second blade 222-*f* of the first terminal 112*a*. A contact surface on each finger of the second set of fingers 224-*s* of the second terminal 122*a* may provide a low resistance contact to the first blade 212-*f* of the first terminal 112*a*.

Moreover, the bent portions of fingers 214-*s* and 224-*f* may provide spring forces on blades 222-*f* and 212-*s*, urging the blades together. This spring force may provide one or more points of contacts between blades 222-*f* and 212-*s*. Likewise, fingers 214-*f* and 224-*s* may provide spring forces on blades 222-*s* and 212-*f*, urging the blades together. This spring force may provide one or more points of contacts between blades 222-*s* and 212-*f*.

In some embodiments, the first and second set of fingers of the first terminal 112*a* may have at least three fingers, providing at least three points of contact, respectively, with surfaces of the second and first blades of the second terminal 122*a*. Similarly, the first and second set of fingers of the second terminal 122*a* may have at least three fingers providing at least three points of contact, respectively, with surfaces of the second and first blades of the first terminal 112*a*. Therefore, terminals 112*a*, 122*a* with two mating regions may provide three points of contact associated with each of two blades on the terminal, providing six points of contact on the fingers in each mating region.

Figure 3C:
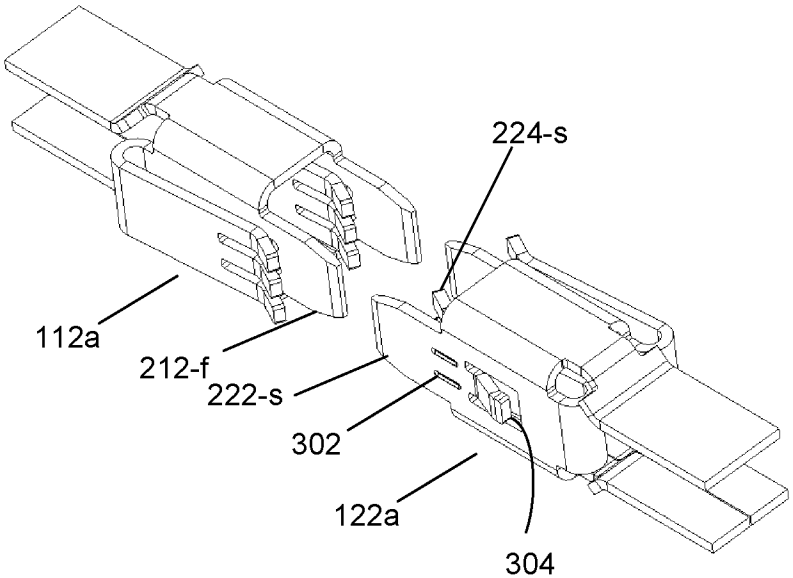

In some embodiments, one or more contact surfaces on one or both of the blades of each of the first and second terminals 112*a*, 122*a* may provide further low resistance points of contact between the terminals. For example, FIG. 3C illustrates the second blade 222-*s* of the second terminal 122*a* including at least one dimple 302. Here, two dimples 302 are illustrated. An inner surface of the second blade 222-*s* (i.e., a surface of the second blade 222-*s* facing the second bent portion 224-*s*) may include a raised portion as a result of dimple 302, forming a contact surface. Upon mating, the dimple 302 provides a contact surface pressing against a surface of the first blade 212-*f* of the first terminal 112*a*. Similar dimples may be provided on the first blade of the second terminal 122*a* and/or the first and second blades of the first terminal 112*a* without departing from the scope of this disclosure.

The terminals may additionally include retention features. In the example embodiment of FIG. 3C, retention features are formed as tabs 304 cut in the metal forming the terminal. In this example, the tabs are cut in an outwardly facing surface of the terminal, here a tab in blade 222-*s* is visible. Tab 304 has a raised distal end facing in a direction opposite the insertion direction of the terminal into a housing. Additional retention features may be formed in other surfaces of the terminal that contact a surface of a connector housing. It should be appreciated that tabs may be used in place of dimples to formed raised surfaces of contact structures. However, the retention features may not include a contact coating. Additionally, while a retention feature is positioned adjacent a surface of a housing such that it may engage the housing, a raised portion serving as a contact structure faces an open space that may receive a mating contact portion from a mating terminal.

In some embodiments, a pair of terminals (e.g., terminals 112*a* and 122*a*), each having two mating regions (e.g., mating regions 210, 220), may provide sixteen points of contact when mated: three points of contact associated with each of two blades/flat portions on one terminal, providing six points of contact on the fingers in each mating region. Two additional points of contact in the form of dimples may be provided on the blades/flat portions. With two mating regions, each with 8 points of contact, a total of 16 points of contact are provided between the mating terminals. For terminals with only one mating region, 8 points of contact may be provided. Accordingly, regardless of the specific configuration, terminals as described herein may provide a high density of contact points in comparison to conventional power terminals.

It should be appreciated that terminals with mating contact portions providing multiple points of contact as described herein may be configured for use in connector configurations other than cable connectors. In some embodiments, the terminals for such connectors may have a different mounting portion than described above for mounting portion 204, but the mating portion may have the same configuration as mating portion 202.

Figure 4B:
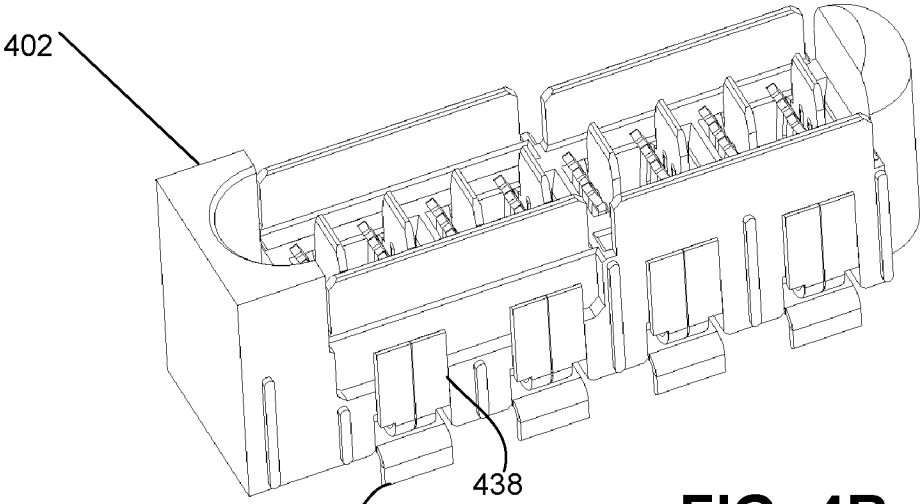
FIG. 4B is perspective view revealing the mating and mounting interfaces of one of the power connectors of FIG. 4A.
Figure 4C:
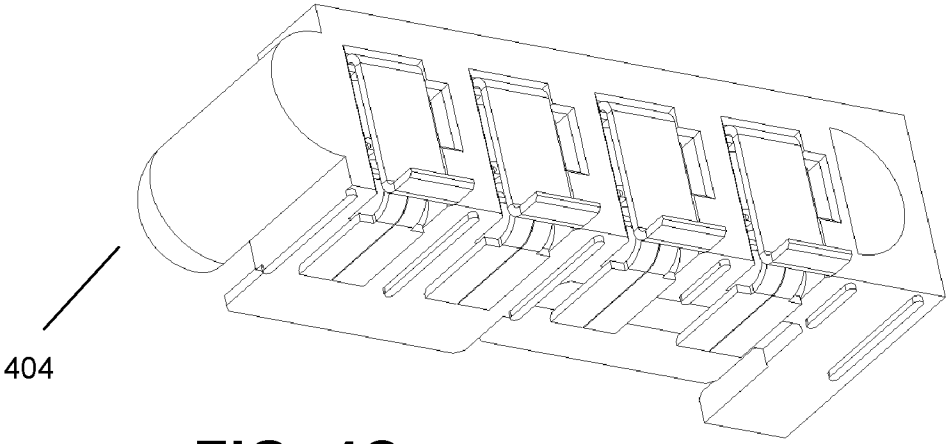
FIG. 4C is a perspective view revealing the back and the mounting interface of one of the power connectors of FIG. 4A.
Figure 4A:
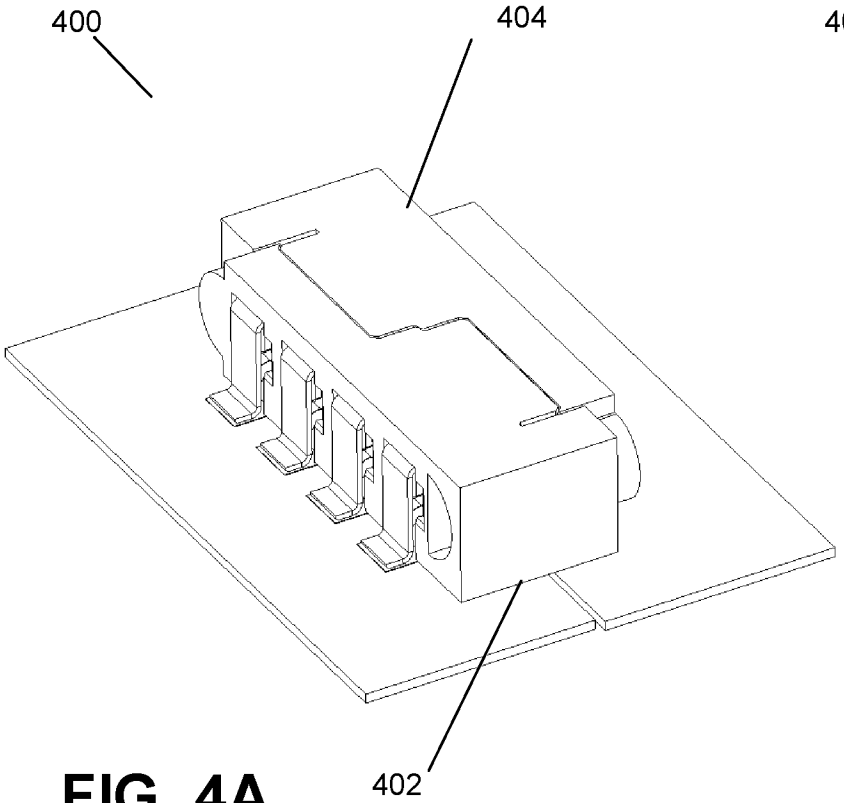
FIG. 4A is a perspective view of two exemplary hermaphroditic surface mount, parallel power connectors, according to some embodiments.

FIGS. 4A-6F illustrate other hermaphroditic power connector designs, where the housing and the terminals on both sides of the connector assembly have a like shape. For example, FIGS. 4A-4C depict a power connector assembly 400 including hermaphroditic right angle surface mount PCB (printed circuit board) connectors 402, 404 configured to mate to each other. As illustrated, the housings have alignment and mating features that provide a mating interface with the same configuration as in FIG. 1B.

Figure 4D:
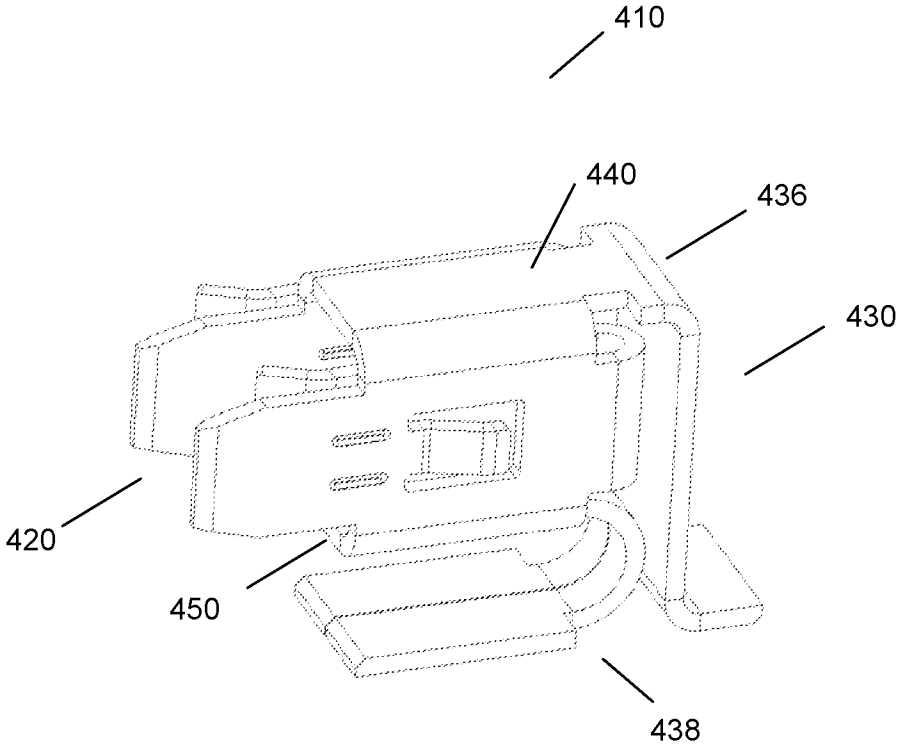
FIG. 4D is a perspective view of a surface mount terminal of the power connector of FIGS. 4A-4C.

Each of the connectors 402, 404 may include a plurality of terminals having a like shape, such as, terminal 410 depicted in FIG. 4D. The mating portion 420 of the terminal 410 may be similar to the mating portions of terminal 112*a* or 122*a*. The mating portion 420 may include one or more dimples on each of the blades. Inner surfaces of the blades may include one or more raised portions that result from one or more dimples, forming one or more contact surfaces. Additionally, the mounting and/or mating portions may include retention features, tapers, coating and other features as described herein in connection with other embodiments.

The mounting portion 430 of the terminal 410 may include the tails 436, 438 extending from the first and second bands 440, 450, respectively. In the illustrated embodiment, each of the tails 436, 438 of the mounting portion 430 is shaped to provide a right angle surface mount contact tail. Such a contact tail has a pad configured for surface mount soldering to a printed circuit board or similar substrate.

In the embodiment of FIG. 4D, terminal 410 is formed from an integral sheet of metal such that the mating portion 420 and the mounting portion 430 are mechanically and electrically connected via that sheet of metal. The pad at the distal end of tail 436 comprises an unbroken pad stamped from that sheet of metal. The pad at the distal end of tail 438, however, is formed from two portions that are folded to be adjacent and planar. In soldering the pad of tail 438 to a substrate, those portions will become electrically and mechanically joined, and will have a high current carrying capacity.

Figure 5C:
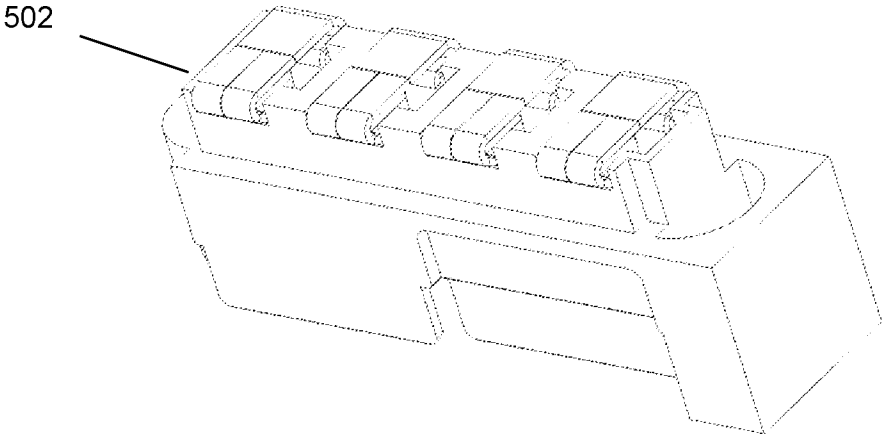
FIG. 5C is a perspective view revealing the mounting interface of one of the power connectors of FIG. 5A.
Figure 5B:
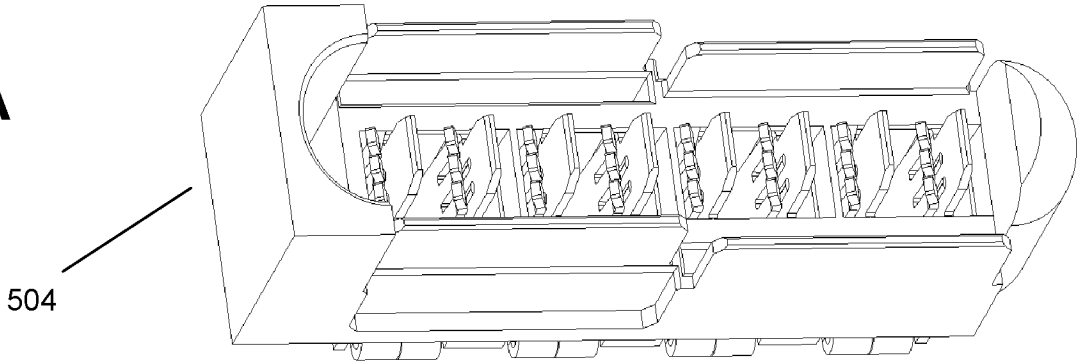
FIG. 5B is perspective view revealing the mating interface of one of the power connectors of FIG. 5A.
Figure 5A:
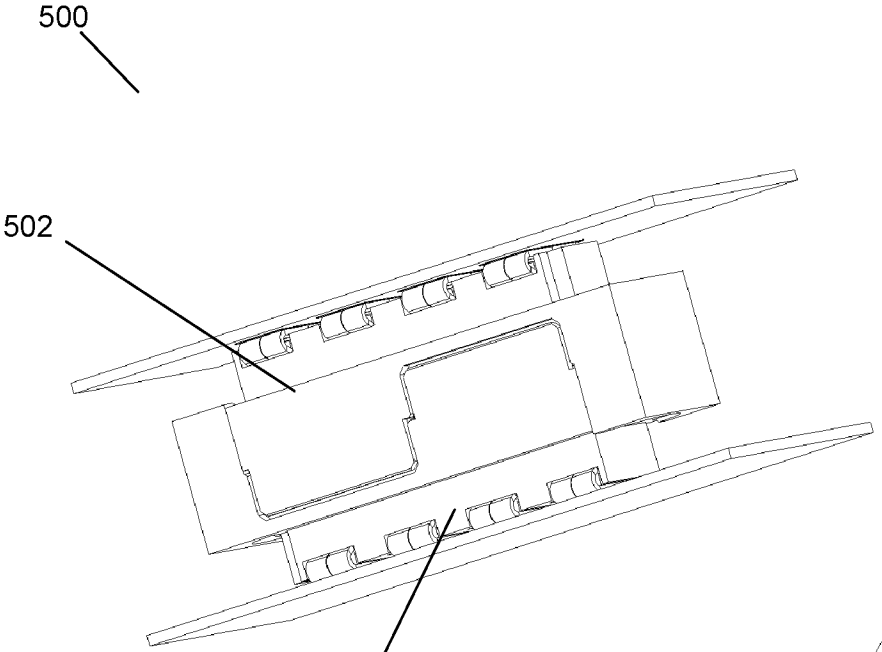
FIG. 5A is a perspective view of two exemplary hermaphroditic surface mount, mezzanine power connectors, according to some embodiments.
Figure 5D:
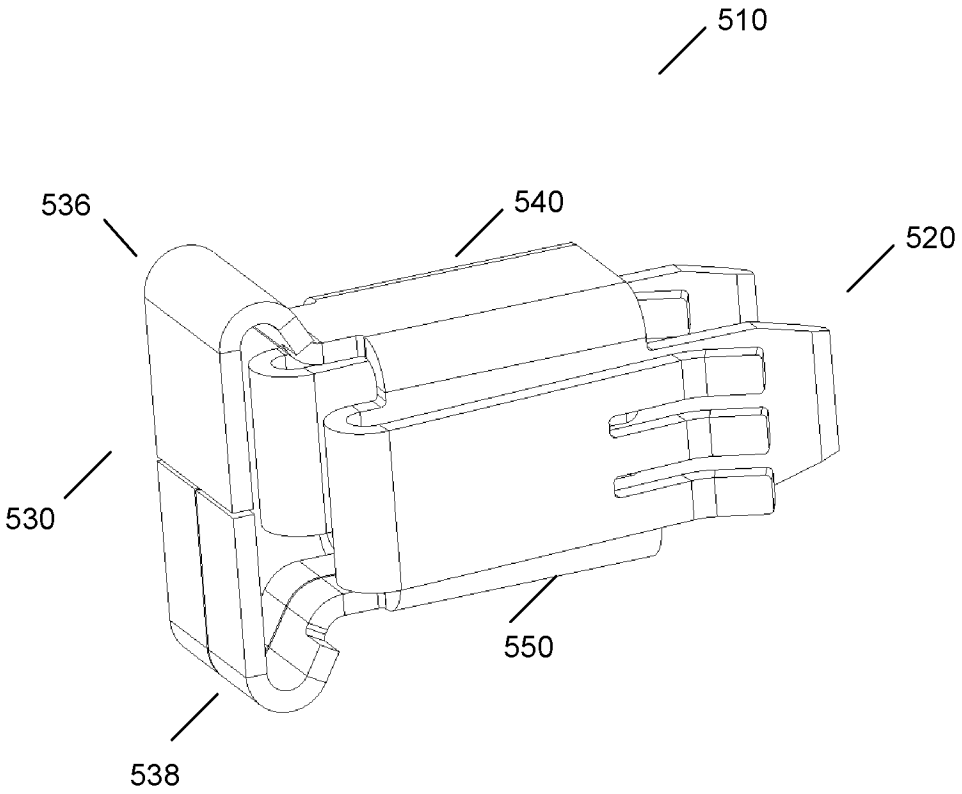
FIG. 5D is a perspective view of a surface mount terminal of the power connector of FIGS. 5A-5C.

FIGS. 5A-5C depict a power connector assembly 500 including hermaphroditic vertical surface mount PCB (printed circuit board) connectors 502, 504 configured to mate to each other. Each of the connectors 502, 504 may include a plurality of terminals having a like shape, such as, terminal 510 depicted in FIG. 5D. The mating portion 520 of the terminal 510 may be similar to the mating portions of terminal 112*a* or 122*a*.

The mounting portion 530 of the terminal 510 may include tails 536, 538 extending from the first and second bands 540, 550, respectively. Each of the tails 536, 538 of the mounting portion 530 may be shaped for a surface mounting, and are here shown to have pads at their distal ends for that purpose. In contrast to the embodiment of FIG. 4D, terminal 510 has tails shaped to provide a vertical surface mount connector.

Figures 6A, 6B:
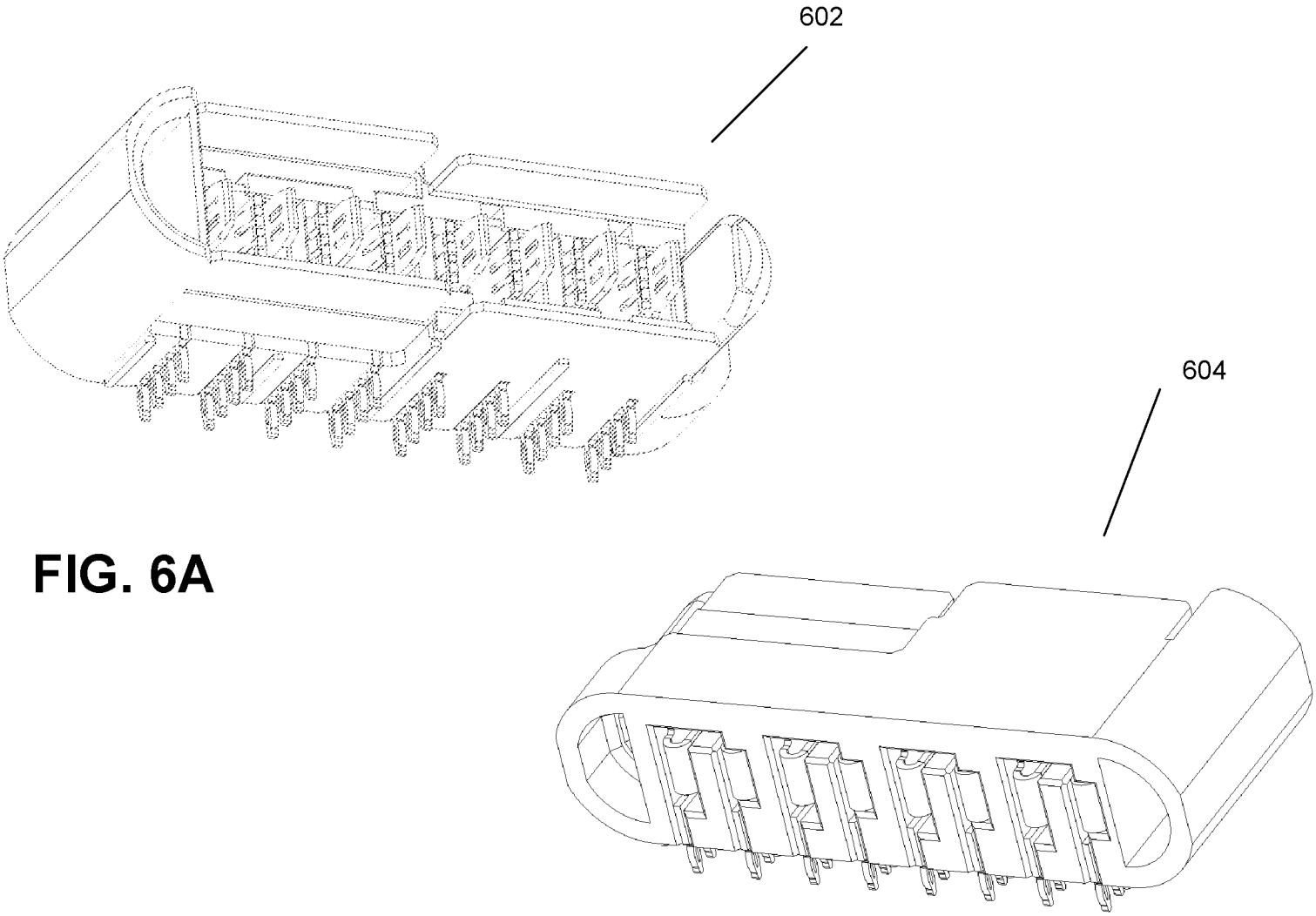
FIG. 6A is a perspective view revealing the mating and mounting interfaces of an exemplary hermaphroditic power connector with press fit terminals, according to some embodiments.
FIG. 6B is a perspective view revealing the back of the power connector of FIG. 6A.
Figure 6D:
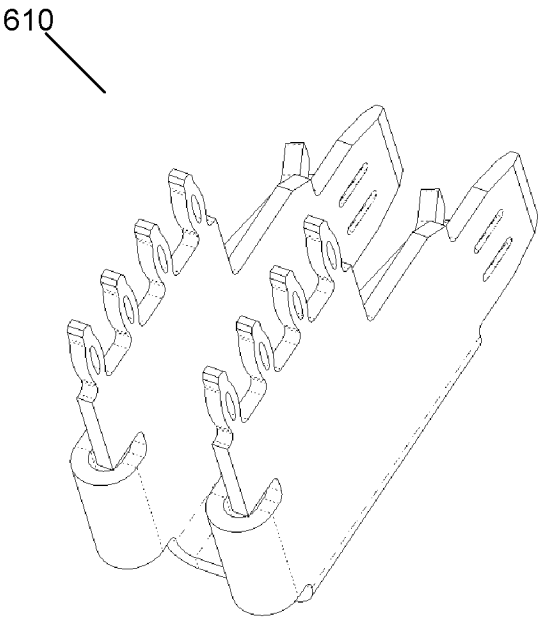
FIG. 6D is a bottom, right side perspective view of the exemplary hermaphroditic press fit power terminal of FIG. 6C.
Figure 6C:
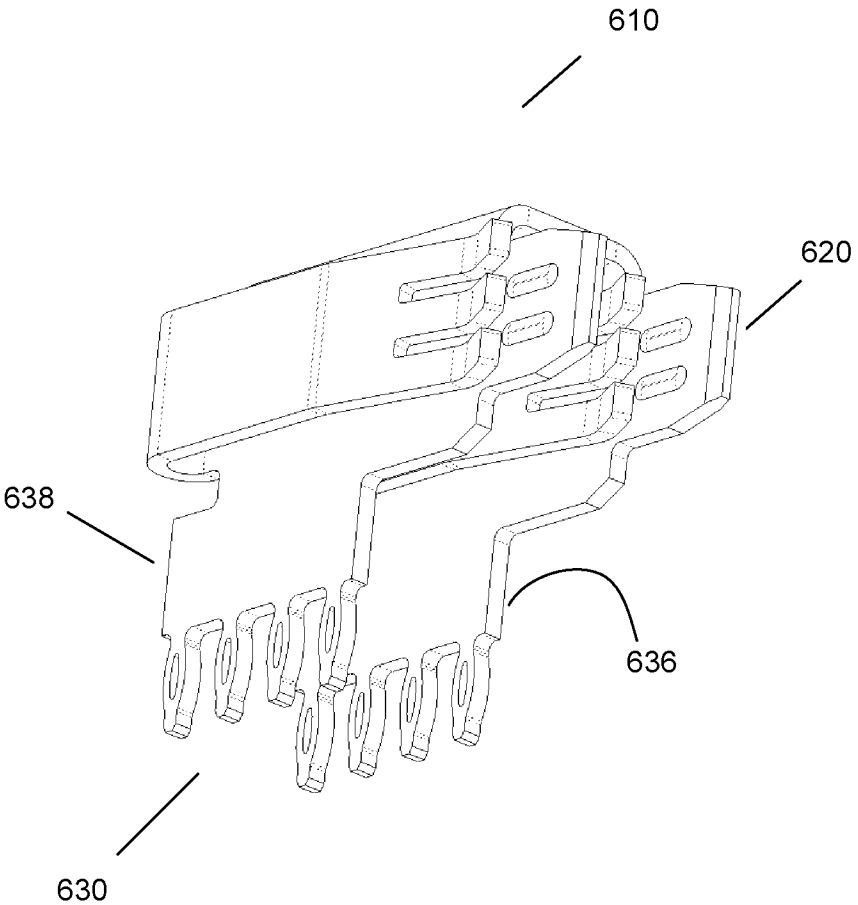
FIG. 6C is a lower, left side perspective view of an exemplary hermaphroditic press fit power terminal, according to some embodiments.

FIGS. 6A and 6B illustrate terminals configured for yet another mating configuration. In this example, the terminals are configured to enable a hermaphroditic press fit PCB (printed circuit board) connector. Connectors 602, 604 have like construction and are configured to mate to each other. Each of the connectors 602, 604 may include a plurality of terminals having a like shape, such as, terminal 610 depicted in FIGS. 6C and 6D. The mating portion 620 of the terminal 610 may be similar to the mating portions of terminal 112*a* or 122*a*. The mating portion 620 may include one or more dimples on each of the blades. Inner surfaces of the flat portions may include one or more raised portions of the one or more dimples forming one or more contact surfaces. Other features described in connection with other embodiments may also be included, such as retention features and contact coatings. However, it should be appreciated that variations in shape and position of those features may be made. For example, retention tabs may be provided at an edge of a blade in addition to or instead of retention tabs 304 (FIG. 3C) in a central portion of a blade.

The mounting portion 630 of the terminal 610 may include at least a tail 638 extending from bottom surfaces of first and second blades of the mating portion 620. At least the tail 638 of the mounting portion 630 may have one or more press fits. In the embodiment, press fits extend from both tails 636 and 638. Eight press fits are illustrated, 4 on each of tails 636 and 638. However, more or fewer press fits may be included. Here, the press fits have an "eye of the needle" shape such that press fits will compress when inserted in a hole in a printed circuit board, generating a force against walls of the hole to make both electrical and mechanical contact between the terminal 610 and the printed circuit board.

Figure 6F:
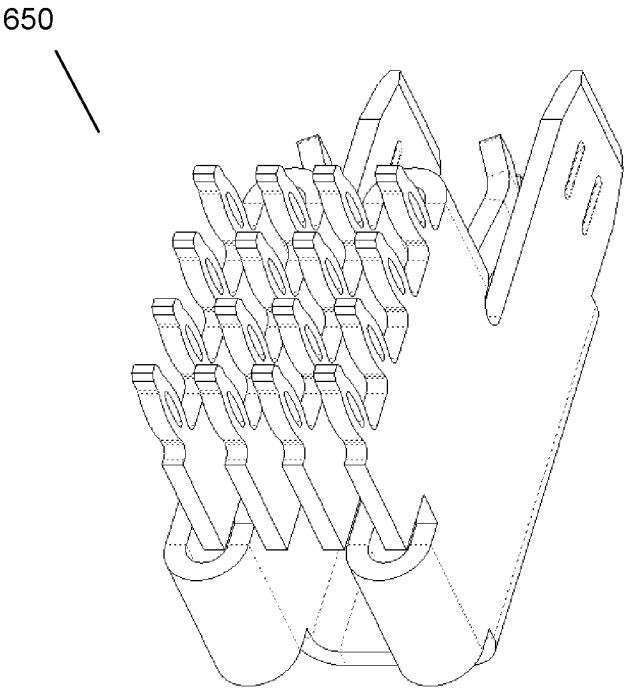
FIG. 6F is a bottom, right side perspective view of the exemplary hermaphroditic press fit power terminal of FIG. 6E.
Figure 6E:
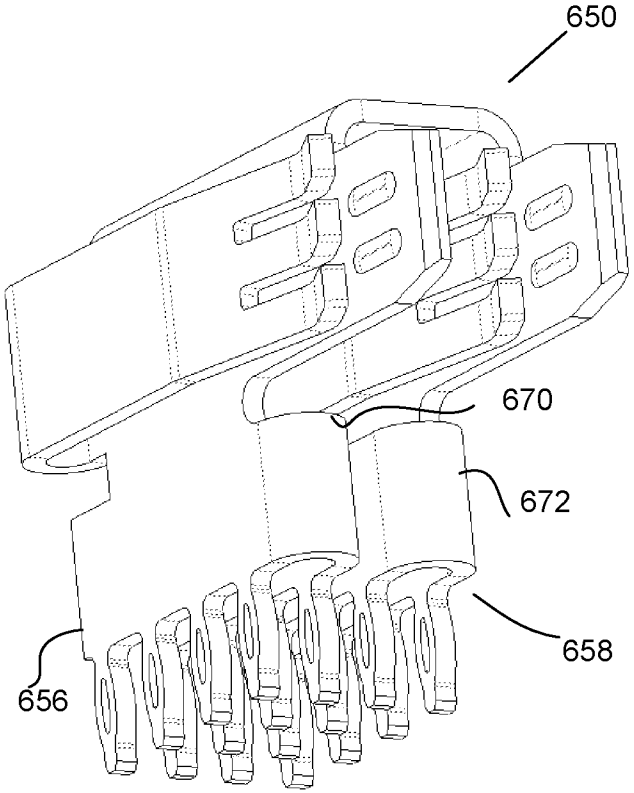
FIG. 6E is a lower, left side perspective view of an exemplary hermaphroditic press fit power terminal, according to an alternative embodiment configured for carrying more current than the terminal of FIG. 6C.

In some embodiments, the solder tail density may be increased by adding two middle rows as shown in terminal 650 of FIGS. 6E and 6F. For example, the number of press fit tails can be increased to 16, which doubles the mechanical retention to the PCB and halves the resistance of the contact between the terminal and the PCB to which it is mounted in comparison to terminal 610. As can be seen from a comparison of FIGS. 6C and 6D to FIGS. 6E and 6F, additional press fits may be formed on tails 656 and 658 by stamping those tails to be longer than their finished configuration and then, forming folds 670 and 672, such that the press fits of each tail may be in parallel rows.

Figure 7B:
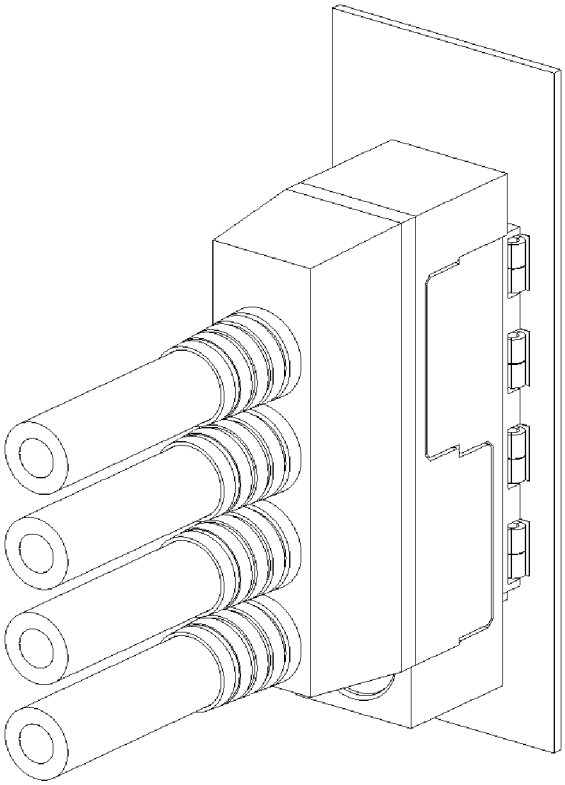
FIGS. 7A-7C illustrate different power connector configurations, according to some embodiments.
Figure 7A:
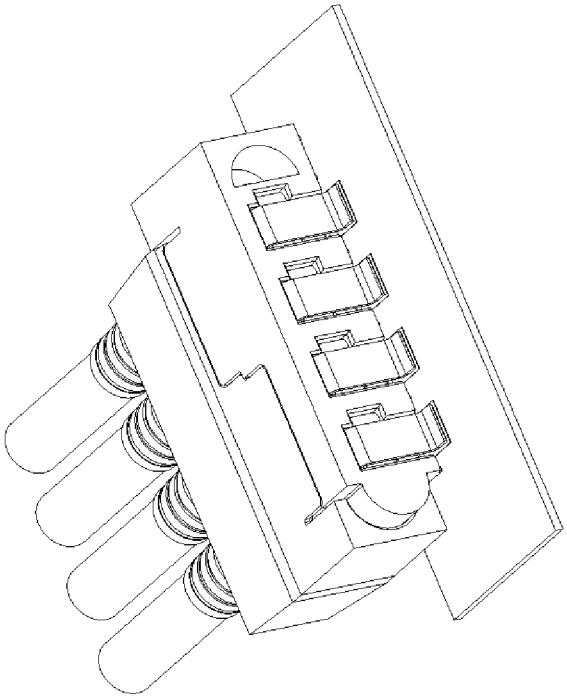
Figure 7C:
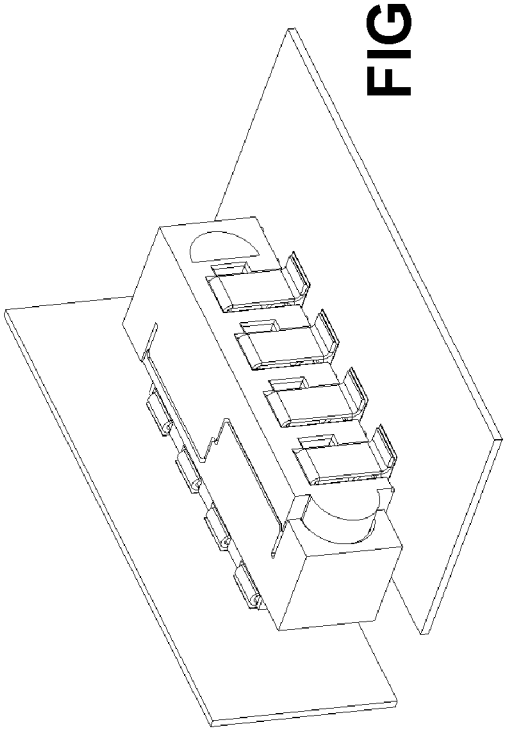

In some embodiments, as illustrated in FIGS. 7A-7C, the different styles of power connectors described herein may be mated to each other because of the similar design of the mating regions of the terminals across the different power connectors. FIG. 7A illustrates a cable mount connector mated with a right angle surface mount connector. FIG. 7B illustrates a cable mount connector mated with a vertical surface mount connector. FIG. 7C illustrates a vertical surface mount connector mated with a right angle surface mount connector.

Figure 8A:
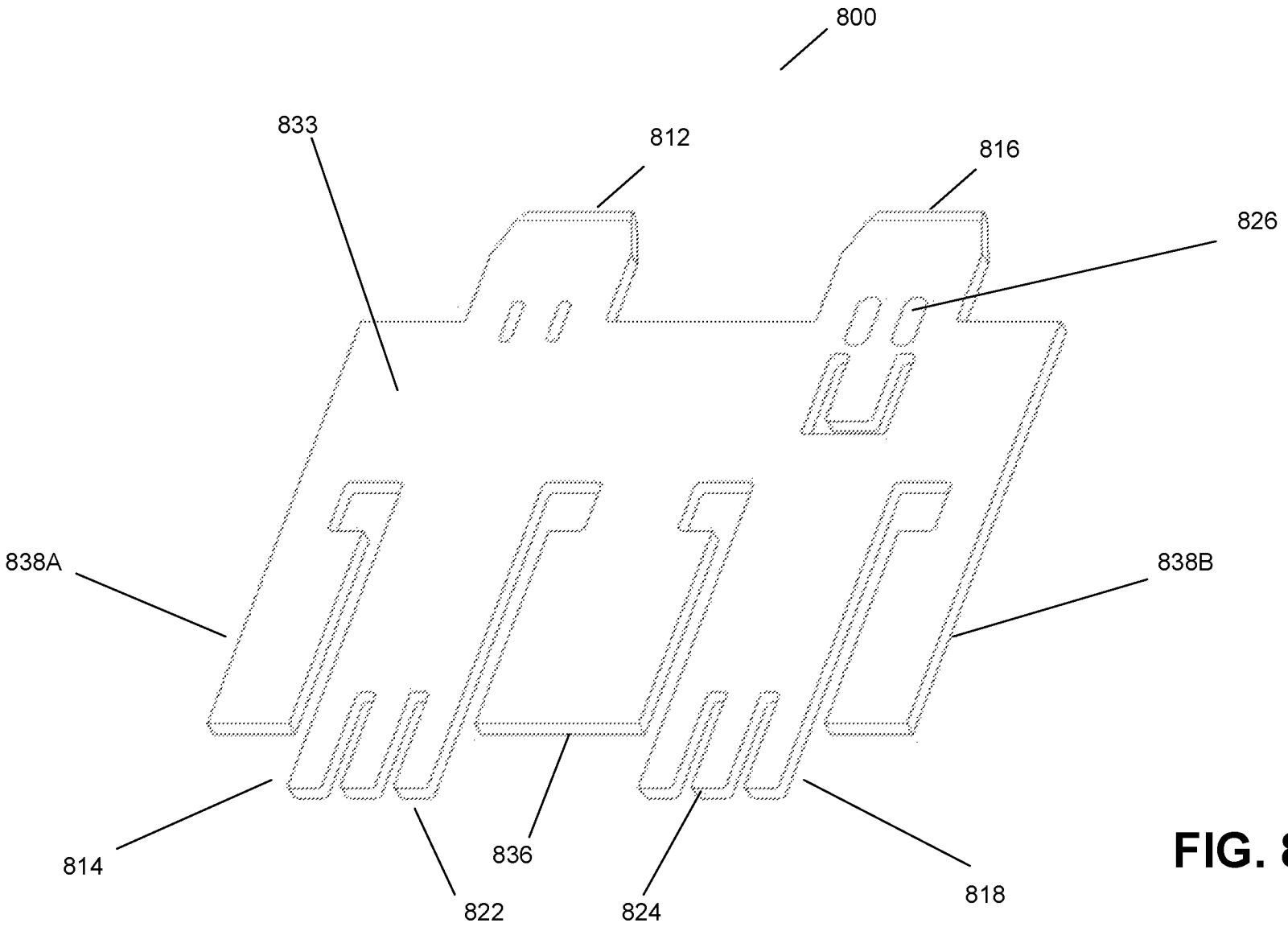
FIGS. 8A-8E illustrate example blanks used to form power terminals associated with different types of power connectors, according to some embodiments.
Figure 8C:
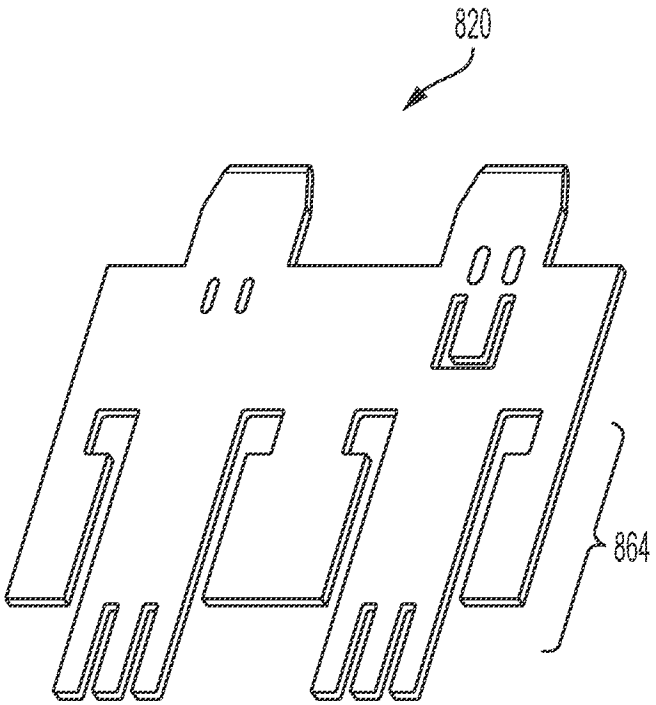
Figure 8B:
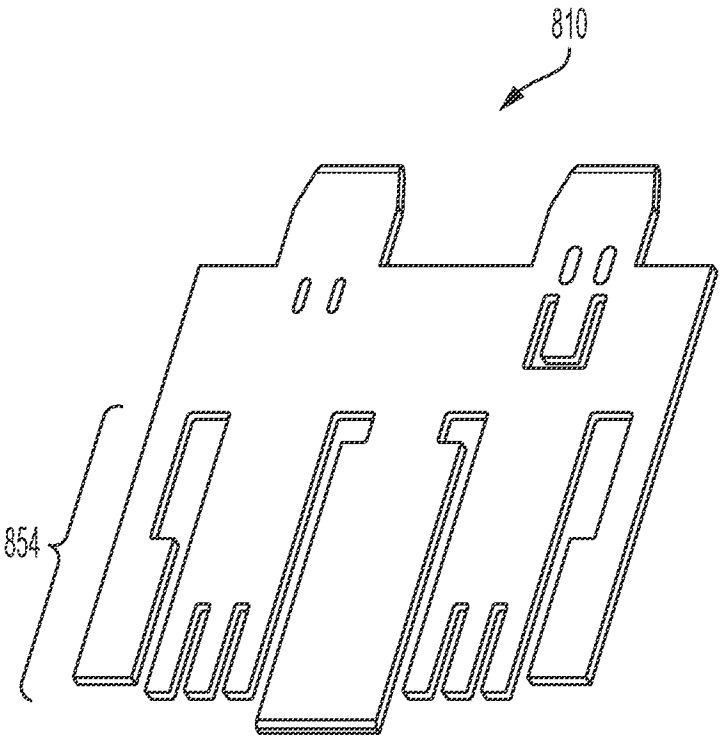
Figure 8E:
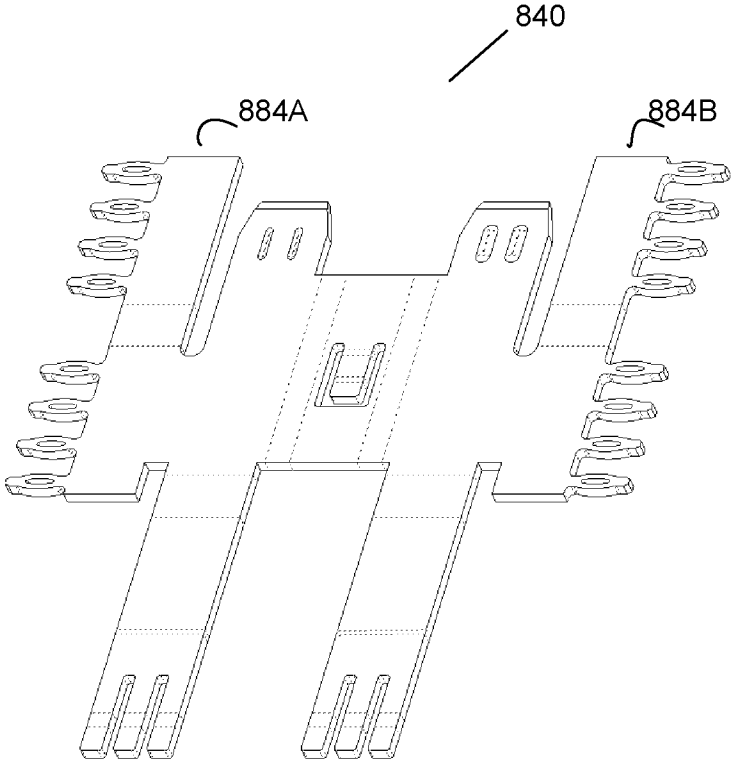
Figure 8D:
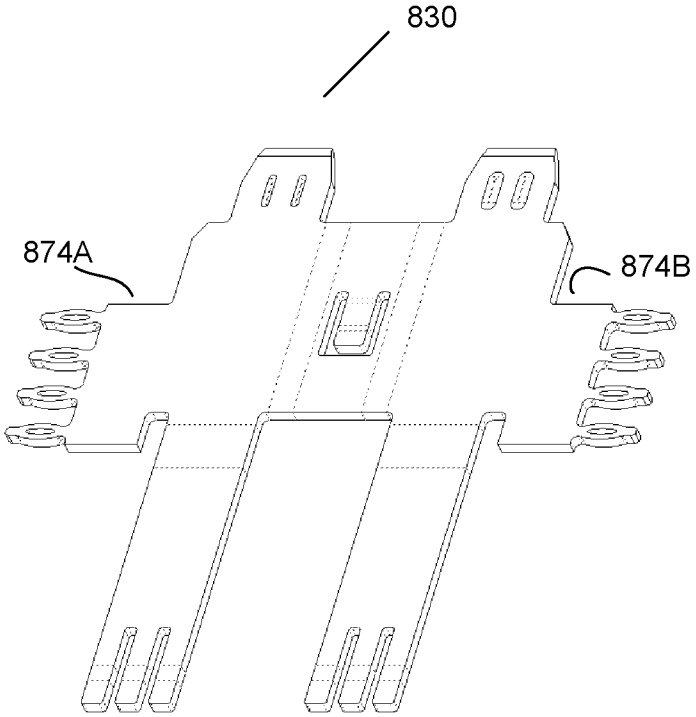

Example methods of manufacturing terminals for power connectors are provided. Known metal stamping, plating and forming techniques may be used to form terminals with the shape described herein. For example, FIG. 8A illustrates a blank 800 stamped from a sheet of metal. In this example, the blank is shaped to be formed into one of the first or second terminals 112*a-d*, 122*a-d* of the first and second power connectors 110, 120. Blanks, shaped to form terminals in other configurations may be manufactured through a similar process, but with different shape to the portions that will be formed into the terminal tails. The blank 800 may be made of electrically conductive material, for instance, copper alloy or other metal, including for example phosphor bronze. In accordance with some embodiments, the material may have a thickness between 0.5 and 1.5 mm, or between 0.7 and 1.0 mm in some embodiments or 0.8 mm+/−5% in some embodiments. Such a blank may provide sufficient stiffness to form blades but also fingers that generate a mating force. Moreover, such a blank, when formed into a terminal as described herein, may provide a sufficiently low resistance between the contact tails and mating contacts to support currents in excess of 70 A, or, in some embodiments, between 75 and 125 A with less than a 30 degree centigrade temperature rise.

The blank 800 may include a first elongated portion 812, a second elongated portion 814, a third elongated portion 816, and a fourth elongated portion 818. A first set of fingers 822 may be formed in the second elongated portion 814 and a second set of fingers 824 may be formed in the fourth elongated portion 818. Some or all of the portions of the blank 800 may be plated or otherwise coated with a contact coating. The coating may be applied to the upper surface 833 or to the opposing surface (not shown) to provide contact surfaces in the desired location when the blank is formed into a terminal.

In the illustrated embodiment, the first elongated portion 812 is aligned with the second elongated portion 814. The second elongated portion 814 may be bent to be parallel with the first flat elongated portion 812. First elongated portion 812 may be shaped to provide a blade as described herein and the second elongated portion may be shaped to provide a first set of fingers 822.

Third elongated portion 816 and fourth elongated portion 818 may be aligned such that the fourth elongated portion 818 may be bent to be parallel with the third elongated portion 816. Third elongated portion 816 may be shaped to provide a blade and fourth elongated portion 818 may be shaped to provide a second set of fingers 824. Each finger in the first set of fingers 822 may include a convex portion facing the first elongated portion 812 and each finger in the second set of fingers 824 may include a convex portion facing the third elongated portion 816. In some embodiments, a raised portion 826 may be formed on the first elongated portion 812, the third elongated portion 816, or both. The raised portions may be formed by embossing dimples in elongated portion 816 or in any other suitable way. Similarly, retention tabs and other desired features may be formed in elongated portion 816 and/or any other portion of the blank.

Blank 800 includes portions that, when the blank is formed into a terminal provide tails. Here, blank 800 includes a band, joining elongated portions 812 and 816, and providing a connection for portions that are formed into tails for the terminal. In the embodiment illustrated in FIG. 8A, blank 800 includes portions that maybe formed into tails for attachment to a cable, as shown in FIG. 2. Portion 836, for example, may be formed into the shape of tail 206. Portions 838A and 838B may be formed to, together, form tail 208.

FIGS. 8B-8E illustrate blanks 810, 820, 830, 840 used for forming various terminals, such as, terminal 410, terminal 510, terminal 610, and terminal 650, respectively. Each of the blanks 810, 820, 830, 840 have four elongated portions and first and second set of fingers similar to blank 800. The terminals 410, 510, 610, and 650 may be formed in a manner similar to terminals 112*a*, 122*a*, for example, by bending the elongated portions with the fingers to be parallel with the flat elongated portions. The blanks, however, may include portions 854, 864, 874A and 874B and 884A and 884B that, when formed, make up the mounting portion of the terminal.

In some embodiments, each of the terminals has at least one set of fingers facing a blade. Such a terminal is configured to receive and mate with at least a blade inserted between the fingers and the blade. For example, when terminal 112*a* mates with terminal 122*a*, blade 222-*s* fits between fingers 214-*f* and blade 212-*f*. In that configuration spring force generated by fingers 214-*f* both provides a mating force between fingers 214-*f* and blade 222-*s* and presses blade 222-*s* against blade 212-*f* so that there are multiple points of contact.

In the embodiment illustrated, in which like terminals are mated, fingers 224-*s* similarly supply a spring force such that fingers 224-*s* press against blade 212-*f* and draw blades 212-*f* and 222-*s* together to increase the force between. This increase in force between blades 212-*f* and 222-*s* results from mating like terminals that both have blades and fingers. Increase in mating force reduces contact resistance and enables a connector formed with such terminal to operate at high currents, such as between 75 and 100 Amps per terminal, as described herein.

Figure 9B:
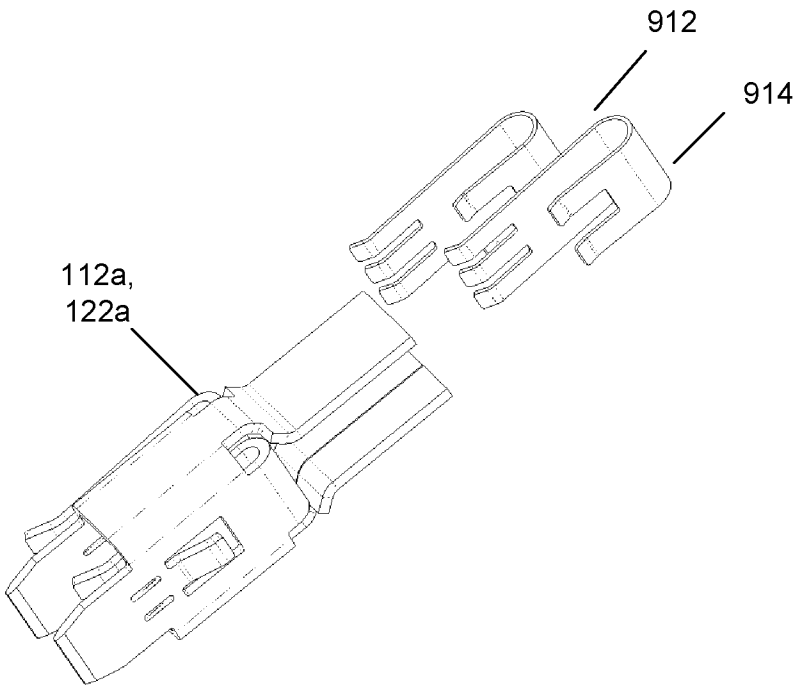
FIGS. 9A and 9B are perspective views from the left front and right side, respectively, of exemplary power terminals with one or more helper springs during assembly.
Figure 9A:
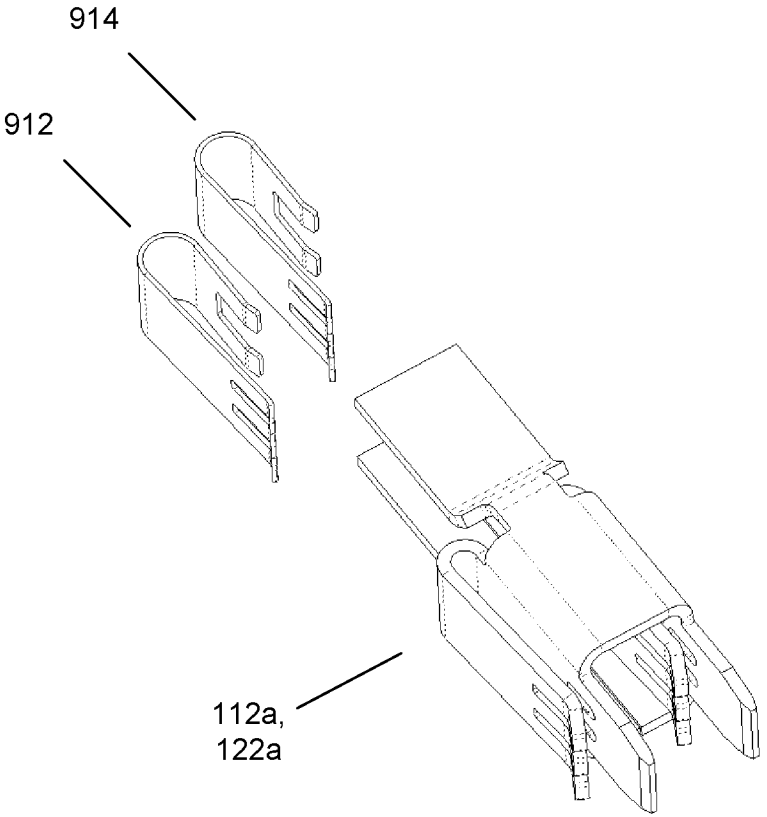
Figure 10A:
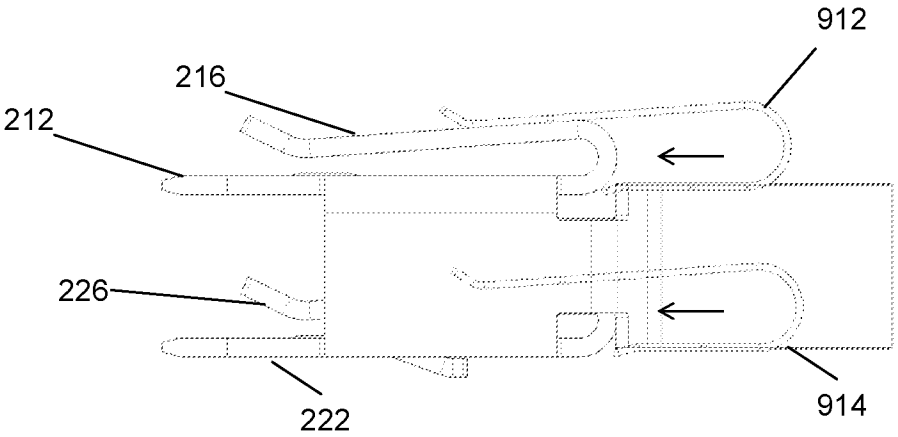

The inventors have realized that in some instances normal forces exerted by the fingers may not be sufficient depending on the base material chosen for the terminal. In some embodiments, helper springs may be added to the terminals to increase the normal force. For example, as shown in FIGS. 9A-9B, one or more helper springs 912, 914 may be added to the first and/or second terminals, such as, terminal 112*a*, 122*a*. In the example of FIG. 10A, helper spring 912 may be designed to slip over the first blade 212 and first bent portion 216 of a terminal (e.g., terminal 112*a*) and helper spring 914 may be designed to slip over the second blade 222 and second bent portion 226 of the terminal. The helper spring 912 may have a shape similar to the combined bent shape of the first blade 212 and first bent portion 216. The helper spring 914 may have a shape similar to the combined bent shape of the second blade 222 and second bent portion 226. The helper springs may have a higher spring constant than the fingers of the terminal. A higher spring constant may be achieved, for example, using a different material than is used to form the terminal. A suitable material may be readily selected as the material may have a higher resistance than the material used to form the fingers of the terminal, without impacting the current carrying capacity of the terminals.

Figure 10B:
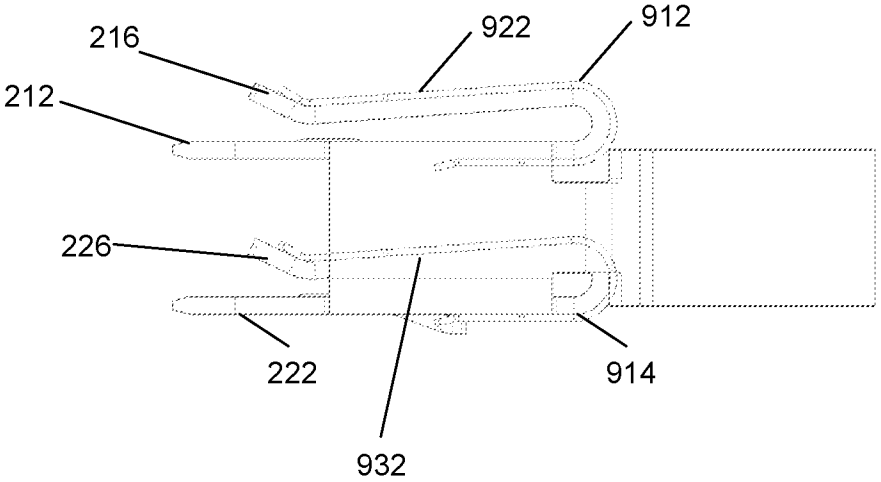

FIG. 10B illustrates the arrangement of the helper springs 912, 914, where a first portion 922 of the helper spring 912 substantially overlaps the first bent portion 216 and the first set of fingers 214 and the first portion 932 of the helper spring 914 substantially overlaps the second bent portion 226 and the second set of fingers 224.

It will be appreciated that while FIGS. 9A, 9B, 10A, and 10B depict helper springs added to terminals 112*a*, 122*a*, the helper springs may also be added to terminals with other configurations, such as terminals 410, 510, 610, and 650, without departing from the scope of this disclosure.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

What is claimed is:

1. A power connector comprising:

a first terminal comprising:

a first flat portion; and a first bent portion comprising a first end and a second end, the first end being coupled to the first flat portion and the second end comprising a first set of fingers parallel to the first flat portion, the first set of fingers arranged in a line, each finger in the first set of fingers extending in a same direction from the first end to the second end of the first bent portion, the first set of fingers comprising contact surfaces facing towards the first flat portion.

2. The power connector of claim 1, wherein:

the first flat portion has a first end and a second end with the first end of the first bent portion being coupled to the first flat portion at the first end of the first flat portion; and the second end of the first flat portion extends beyond the second end of the first bent portion in a direction from the first end to the second end of the first flat portion.

3. The power connector of claim 1, wherein:

the first flat portion comprises a surface facing the first bent portion; and the surface comprises at least one raised portion forming a contact surface.

4. The power connector of claim 1, wherein:

the first terminal further comprises:

a second flat portion; and a second bent portion comprising a first end and a second end, the first end of the second bent portion being coupled to the second flat portion and the second end of the second bent portion comprising a second set of fingers parallel to the second flat portion.

5. The power connector of claim 4, wherein:

the first flat portion, the second flat portion, the first bent portion and the second bent portion are integral metal members.

6. The power connector of claim 4, wherein the first flat portion, the second flat portion, the first bent portion and the second bent portion together have a cross section that is less than 10 mm square.

7. A power connector comprising a first terminal comprising:

a first flat portion;

a first bent portion comprising a first end and a second end, the first end being coupled to the first flat portion and the second end comprising a first set of fingers parallel to the first flat portion, the first set of fingers arranged in a line and extending in a direction from the first end to the second end of the first bent portion, the first set of fingers comprising contact surfaces facing towards the first flat portion;

a second flat portion;

a second bent portion comprising a first end and a second end, the first end of the second bent portion being coupled to the second flat portion and the second end of the second bent portion comprising a second set of fingers parallel to the second flat portion; and a band connecting the first flat portion to the second flat portion.

8. The power connector of claim 7, further comprising:

a contact tail extending from the band or a bottom surface of the first flat portion or second flat portion.

9. The power connector of claim 8, wherein the contact tail is a cable mount contact tail, a right angle surface mount contact tail, a vertical surface mount contact tail, or a press fit contact tail.

10. The power connector of claim 4, wherein:

the first set of fingers comprises at least three fingers, each of the at least three fingers of the first set of fingers providing a contact surface facing towards the first flat portion; and the second set of fingers comprises at least three fingers, each of the at least three fingers of the second set of fingers providing a contact surface facing towards the second flat portion.

11. The power connector of claim 1, in combination with a second power connector, the second power connector comprising:

a second terminal comprising:

a second flat portion; and a second bent portion comprising a first end and a second end, the first end of the second bent portion being coupled to the second flat portion and the second end of the second bent portion comprising a second set of fingers parallel to the second flat portion.

12. The power connector in the combination of claim 11, wherein the first terminal and the second terminal are mated to each other, with the second set of fingers of the second terminal contacting a surface of the first flat portion and the first set of fingers of the first terminal contacting a surface of the second flat portion.

13. The power connector in the combination of claim 12, wherein the second set of fingers provide at least three points of contact with the surface of the first flat portion and the first set of fingers provide at least three points contact with the surface of the second flat portion.

14. The power connector in the combination of claim 13, wherein at least two points of contact are provided on the first flat portion and/or the second flat portion thereby providing sixteen points of contact when the first terminal and the second terminal are mated to each other.

15. The power connector in the combination of claim 11, wherein at least one of the first flat portion and second flat portion comprises a raised portion providing a contact surface pressing against a surface of the other of the first flat portion and second flat portion.

16. A power connector assembly comprising:

a first power connector comprising a plurality of first terminals, wherein each first terminal of the plurality of first terminals comprises:

a first flat portion, and a first bent portion comprising a first end and a second end, the first end being coupled to the first flat portion and the second end comprising a first set of fingers parallel to the first flat portion; and a second power connector configured to mate with the first power connector and comprising a plurality of second terminals, wherein each second terminal of the plurality of second terminals comprises:

a second flat portion, and a second bent portion comprising a first end and a second end, the first end of the second bent portion being coupled to the second flat portion and the second end of the second bent portion comprising a second set of fingers parallel to the second flat portion, wherein each first terminal of the first power connector is mated to a corresponding second terminal of the second power connector, with the second set of fingers of the second terminal contacting a surface of the first flat portion of the first terminal and the first set of fingers of the first terminal contacting a surface of the second flat portion of the second terminal.

17. The power connector assembly of claim 16, wherein the second set of fingers provides at least three points of contact with the surface of the first flat portion and the first set of fingers provides at least three points of contact with the surface of the second flat portion.

18. The power connector assembly of claim 16, wherein one of the first flat portion and second flat portion comprises a raised portion providing a contact surface pressing against a surface of the other of the first flat portion and second flat portion.

19. The power connector assembly of claim 16, wherein each first terminal of the first power connector is mated to a corresponding second terminal of the second power connector and sixteen points of contact are provided between the mating terminals.

20. The power connector assembly of claim 16, wherein the power connector assembly has a current capacity between 75 and 125 Amps.

21. The power connector assembly of claim 16, wherein the first and second power connectors are cable mount power connectors.

22. The power connector assembly of claim 16, wherein the first power connector is a cable mount power connector and the second power connector is a right angle surface mount power connector.

23. The power connector assembly of claim 16, wherein the first power connector is a cable mount power connector and the second power connector is a vertical surface mount power connector.

24. The power connector assembly of claim 16, wherein the first power connector is a vertical surface mount power connector and the second power connector is a right angle surface mount power connector.

25. A method of manufacturing a terminal for a power connector, the method comprising:

stamping from a sheet of metal a blank comprising a first elongated portion a second elongated portion, a third elongated portion and a fourth elongated portion, wherein the second elongated portion comprises a first plurality of fingers arranged in a line;

bending the second elongated portion including the first plurality of fingers to be parallel with the first elongated portion;

forming the second elongated portion such that each of the first plurality of fingers comprises a convex portion facing towards the first elongated portion;

forming in the fourth elongated portion a second plurality of fingers; and bending the fourth elongated portion such that the second plurality of fingers are parallel with the third elongated portion, and each of the second plurality of fingers comprises a convex portion facing the third elongated portion.

26. The method of claim 25, further comprising forming a raised portion on the first elongated portion.

* * * * *